US008814472B2

(12) United States Patent
Takeda et al.

(10) Patent No.: US 8,814,472 B2
(45) Date of Patent: Aug. 26, 2014

(54) TUNNEL EXCAVATION APPARATUS AND TUNNEL EXCAVATION METHOD

(71) Applicant: Kabuki Construction Co., Ltd., Mito (JP)

(72) Inventors: Mitsuo Takeda, Aizuwakamatsu (JP); Masahiro Kabuki, Tokyo (JP)

(73) Assignee: Kabuki Construction Co., Ltd., Ibaraki (JP)

( * ) Notice: Subject to any disclaimer, the term of this patent is extended or adjusted under 35 U.S.C. 154(b) by 62 days.

(21) Appl. No.: 13/683,621

(22) Filed: Nov. 21, 2012

(65) Prior Publication Data

US 2013/0076100 A1 Mar. 28, 2013

Related U.S. Application Data

(63) Continuation of application No. PCT/JP2011/061642, filed on May 20, 2011.

(30) Foreign Application Priority Data

May 26, 2010 (JP) ..... 2010-120071
Nov. 17, 2010 (JP) ..... 2010-256476

(51) Int. Cl.
*E21D 9/06* (2006.01)
*E21D 9/10* (2006.01)
*E21D 9/11* (2006.01)
*E21D 9/12* (2006.01)

(52) U.S. Cl.
CPC ..... *E21D 9/1006* (2013.01); *E21D 9/0621* (2013.01); *E21D 9/112* (2013.01); *E21D 9/124* (2013.01)
USPC ..... 405/142

(58) Field of Classification Search
USPC ..... 405/142, 145
See application file for complete search history.

(56) References Cited

U.S. PATENT DOCUMENTS 3,325,217 A * 6/1967 Enz ..... 299/31
4,095,435 A * 6/1978 Uemura ..... 405/135
5,051,033 A * 9/1991 Grotenhofer ..... 405/147

FOREIGN PATENT DOCUMENTS

CN 1730907 A 2/2006
CN 1865659 A 11/2006

(Continued)

OTHER PUBLICATIONS

Written Opinion of the International Searching Authority for International Application No. PCT/JP2011/061642, dated Aug. 23, 2011, 3 pages.

(Continued)

*Primary Examiner* — John Kreck
(74) *Attorney, Agent, or Firm* — Brinks Gilson & Lione

(57) ABSTRACT

Disclosed is a tunnel excavating apparatus for excavating tunnels in earth. This tunnel excavating apparatus comprises shell bodies, an excavating mechanism disposed on front of the excavating portion shell body, and a propelling mechanism disposed within the shell body. The shell bodies include an excavating portion shell body, a front shell body, and a rear shell body disposed in order from the leading end side in the advancing direction of excavation. The propelling mechanism comprises a projection mechanism and an extension mechanism. The projection mechanism includes front circumferential jacks in the front shell body and rear circumferential jacks in the rear shell body, both of which are capable of extension and contraction in the outer circumferential direction. The extension mechanism includes front axial jacks interposed between the excavating portion shell body and the front shell body, and rear axial jacks interposed between the front shell body and the rear shell body, both of which are capable of extension and contraction in the direction of advancing excavation.

2 Claims, 21 Drawing Sheets

(56) References Cited

FOREIGN PATENT DOCUMENTS

| | | | |
|---|---|---|---|
| DE | 2439798 | | 3/1976 |
| JP | 42-005789 | Y1 | 3/1967 |
| JP | 43-026133 | Y1 | 10/1968 |
| JP | 01-304295 | A | 12/1989 |
| JP | 04-238997 | A | 8/1992 |
| JP | 04-366300 | A | 12/1992 |
| JP | 06-010590 | A | 1/1994 |
| JP | 09-123157 | A | 5/1997 |
| JP | 2840732 | B2 | 12/1998 |
| JP | 2010024734 | A | 2/2010 |
| RU | 2226608 | | 4/2004 |

OTHER PUBLICATIONS

Office Action dated Mar. 31, 2014 issued on Chinese application No. 201180036271.7, 5 pages.

International Search Report for International Application No. PCT/JP2011/061642, dated Aug. 23, 2011, 2 pages.

* cited by examiner

TUNNEL EXCAVATION APPARATUS AND TUNNEL EXCAVATION METHOD

RELATED APPLICATIONS

This application is a continuation of PCT/JP2011/061642 filed on May 20, 2011, which claims priority to Japanese Application Nos. 2010-120071 filed on May 26, 2010 and 2010-256476 filed on Nov. 17, 2010. The entire contents of these applications are incorporated herein by reference.

TECHNICAL FIELD

The present invention pertains to a tunnel excavation apparatus and tunnel excavation method for construction of tunnels in ground.

BACKGROUND ART

The ring shield method has been a well-known method in recent years for efficiently constructing shield tunnels with large cross-sections. In the ring shield method, a tunnel is constructed by excavating earth in an annular cross sectional shape by repetitions of a stage for forward excavation of an annular sectional shape in a position corresponding to the outer shell portion of the tunnel, a stage for constructing a cylindrical lining body in the excavated part, and a stage for propelling the excavating apparatus using reaction force taken from the lining body, and, in parallel to this, excavating column-shaped dirt left behind on the inside of the lining body from behind (see Patent Citation 1).

When using an excavating apparatus for thus forward excavating earth in an annular sectional shape, excavated dirt resulting from excavation of the earth must be transported to the rear of the cylindrical apparatus. For this purpose, in above patent reference 1, a discharge pipe is disposed inside the apparatus and excavated dirt is transported rearward through this discharge pipe. In addition to this discharge pipe, a screw conveyer can also be erected inside the apparatus and excavated dirt transported rearward by this screw conveyor.

However, when excavated dirt discharge mechanisms, such as discharge pipes or screw conveyors, are erected inside the apparatus, the diameter of the discharge pipe or screw conveyor must be reduced in order to assure that they do not interfere with the excavating mechanism or the propelling mechanism, etc., resulting in the problem that large volumes of excavated dirt cannot be transported.

In addition, a small discharge pipe or screw conveyor diameter leads to frequent dirt clogging. When such dirt clogging has occurred, the problem has been that clogged dirt could not be removed without reversing the excavating apparatus and removing the inner shell of the excavating apparatus.

PRIOR ART REFERENCES

Patent References

Patent Reference: Published Patent No. 2840732

SUMMARY OF THE INVENTION

The present invention was undertaken in light of the above-described problems, and has the object of providing a cylindrical excavating apparatus having a rotationally driven annular cutter portion capable of high volume transport of excavated dirt and of easy removal when clogging occurs.

The tunnel excavating apparatus of the present invention is a tunnel excavating apparatus for excavating tunnels in earth, comprising: a cylindrical excavating mechanism, disposed on the leading end in the advancing excavation direction and furnished with an annular cutter portion having on its surface bits for excavating ground, capable of rotationally driving the cutter portion; a shell body, connected to the rear of the excavating mechanism and formed of a cylindrical outer cylinder body and a cylindrical inner cylinder body having an inner diameter larger than the inner diameter of the cutter portion; a propelling mechanism for propelling the excavating mechanism in the direction of advancing excavation; and a spiral blade, attached to the inner circumferential surface of the excavating mechanism inner cylinder body, of a height less than or equal to the difference between the cutter portion inner diameter and the inner cylinder body inner diameter, rotationally driven together with the cutter portion.

Using the present invention, by attaching a spiral blade along the inner circumferential surface of the inside cylindrical body of the excavating mechanism, a large space can be secured without being affected by the space required for the excavating mechanism, the propelling mechanism, or the like, thus enabling the transport of large volumes of excavated soil. When soil clogging occurs, removal of earth remaining inside the excavating apparatus exposes the blade, thereby facilitating the work of removing the clogged soil.

In the present invention, in the excavating mechanism, preferably has a gap is formed to communicate from the surface of the cutter portion through to the inner circumferential surface of the inside cylindrical body excavating mechanism for feeding excavated dirt excavated by the bits to the inner circumference side of the excavating mechanism.

Soil excavated by the cutter portion is thus fed to the inside of the excavating mechanism via the gap.

In the present invention, the propelling mechanism preferably having a projecting mechanism, disposed inside the shell body and capable of projecting a projection portion in the radial outward direction from the outer cylindrical surface of the shell body, and an extension mechanism, disposed inside the shell body, for pushing out the excavating mechanism in the advancing excavation direction by extension using reactive force against the ground in the annularly excavated surrounding area by projecting the protruding portion radially outward.

In the excavating mechanism thus constituted, the work of propelling can be accomplished by projecting protruding portions radially outward using the projection mechanism and applying reactive force against the surrounding ground, therefore excavation of hard ground can be accomplished by receiving a large reaction force even if installation of segments or lining bodies is not complete.

In the present invention, the shell body preferably includes an excavating portion shell body, a front shell body, and a rear shell body sequentially disposed starting from the leading end side in the direction of advancing excavation, and the excavating portion shell body is connected to the rear of the excavating mechanism; the extending mechanism includes front axial jacks, disposed to connect the excavating portion shell body and the front shell body and capable of extending and contracting in the direction of advancing excavation; and rear axial jacks, disposed to connect between the front shell body and the rear shell body, and capable of extending and contracting in the direction of advancing excavation; and the projection mechanism includes front circumferential jacks disposed within the front shell body and capable of extending and contracting radially outward, and rear circumferential jacks disposed within the rear shell body and capable of extending and contracting radially outward.

Using an excavating mechanism thus constituted, a larger reaction force can be received from the ground using front and rear circumferential jacks when propelling the cutter portion forward.

In the present invention, the propelling mechanism preferably comprises: an extension mechanism disposed within the shell body for pushing the excavating mechanism in the direction of advancing excavation by extension in a state whereby reaction force is obtained against segments attached to the inner circumferential surface of a tunnel in which excavation has been completed.

Using an excavating mechanism thus constituted, the length of the excavating mechanism can be shortened.

The excavation method of the present invention is a method for excavating tunnels in ground using a tunnel excavating apparatus, wherein the tunnel excavating apparatus comprises: a cylindrical excavating mechanism, disposed on the leading end in the advancing excavation direction and furnished with an annular cutter portion having on its surface bits for excavating ground, capable of rotationally driving the cutter portion; a shell body, connected to the rear of the excavating mechanism and formed of a cylindrical outer cylinder body and a cylindrical inner cylinder body having an inner diameter larger than the inner diameter of the cutter portion; a propelling mechanism for propelling the excavating mechanism in the direction of advancing excavation; and a spiral blade, attached to the inner circumferential surface of the excavating mechanism inner cylinder body, of a height less than or equal to the difference between the cutter portion inner diameter and the inner cylinder body inner diameter, rotationally driven together with the cutter portion; and including a forward excavation step for excavating earth in an annular shape by pushing said excavating mechanism with the propelling mechanism while rotationally driving the excavating mechanism, and while feeding excavated dirt along the inner circumferential surface of the inner shell using the blade rotating together with the excavating mechanism; and a following excavation step for excavating ground on the inside of an annularly excavated part.

The present invention enables transport of large volumes of excavated dirt, and when dirt clogging does occur, that dirt can be easily removed.

DETAILED DESCRIPTION OF THE PREFERRED EMBODIMENTS

First Embodiment

Below, referring to figures, we discuss details of the excavating apparatus and excavating method constituting a first embodiment of the present invention.

Figure 1:
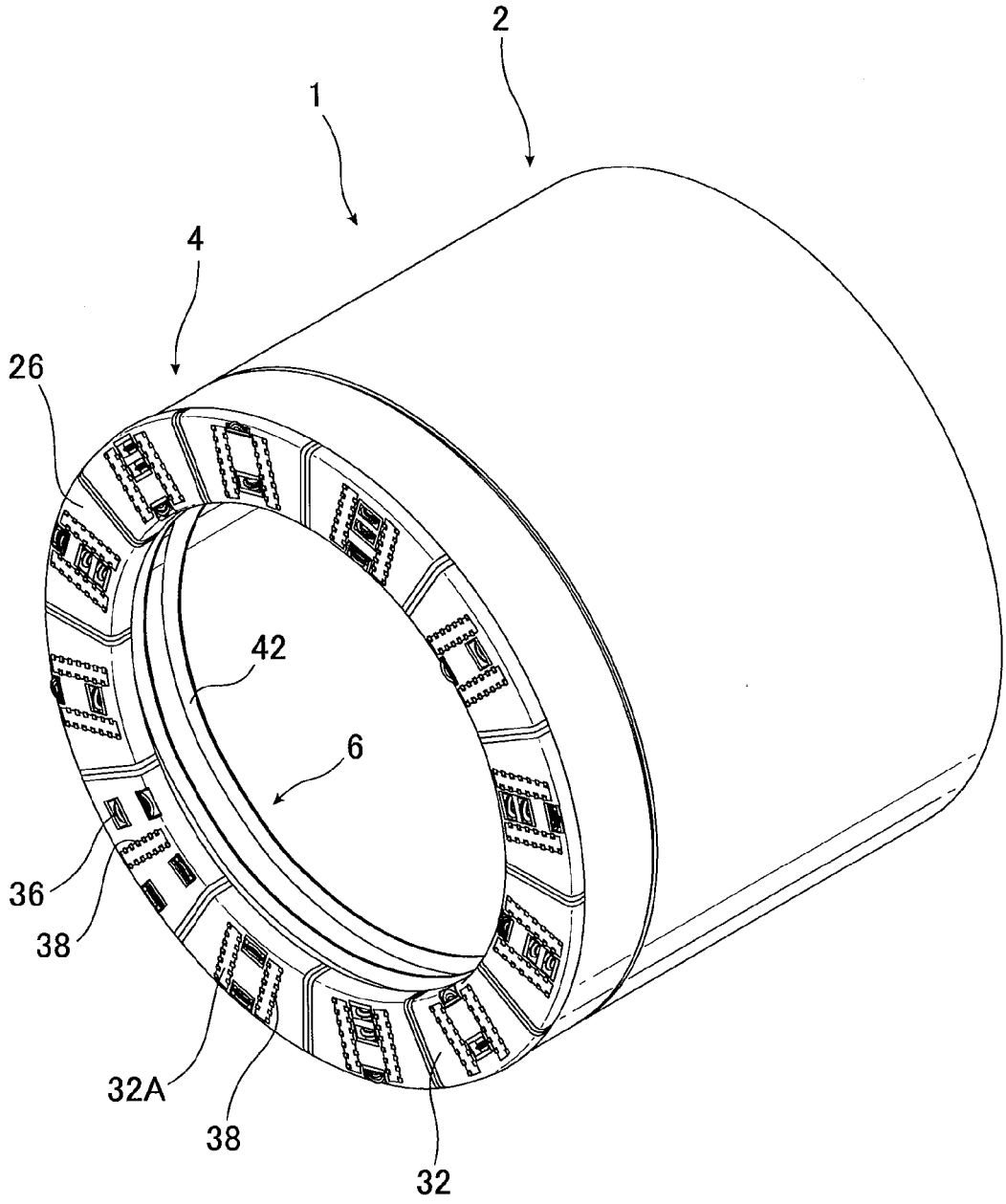
FIG. 1 is a perspective view showing an excavating apparatus according to a first embodiment of the present invention.
Figure 2:
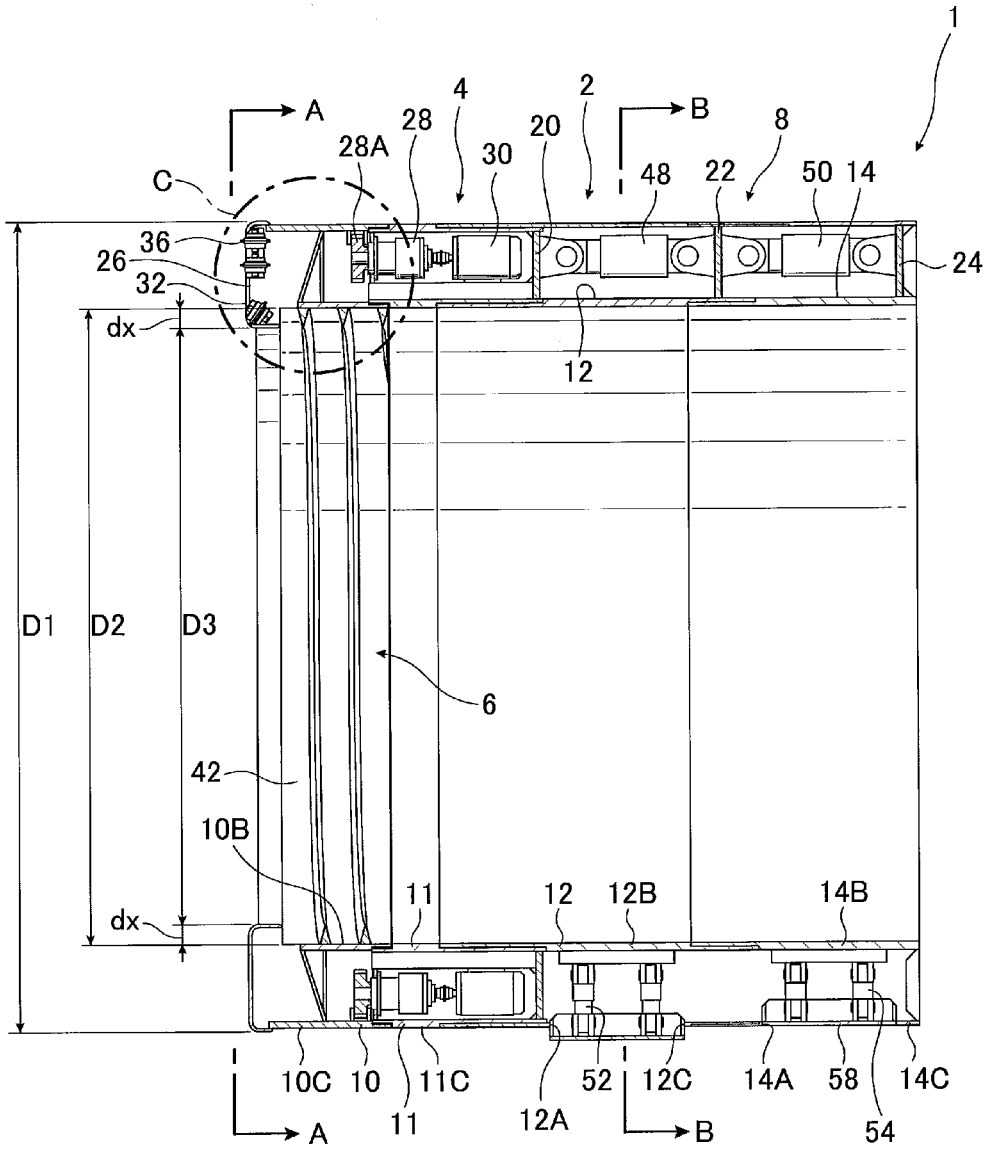
FIG. 2 is a vertical section in the direction of advancing excavation by the excavating apparatus shown in FIG. 1.
Figure 3:
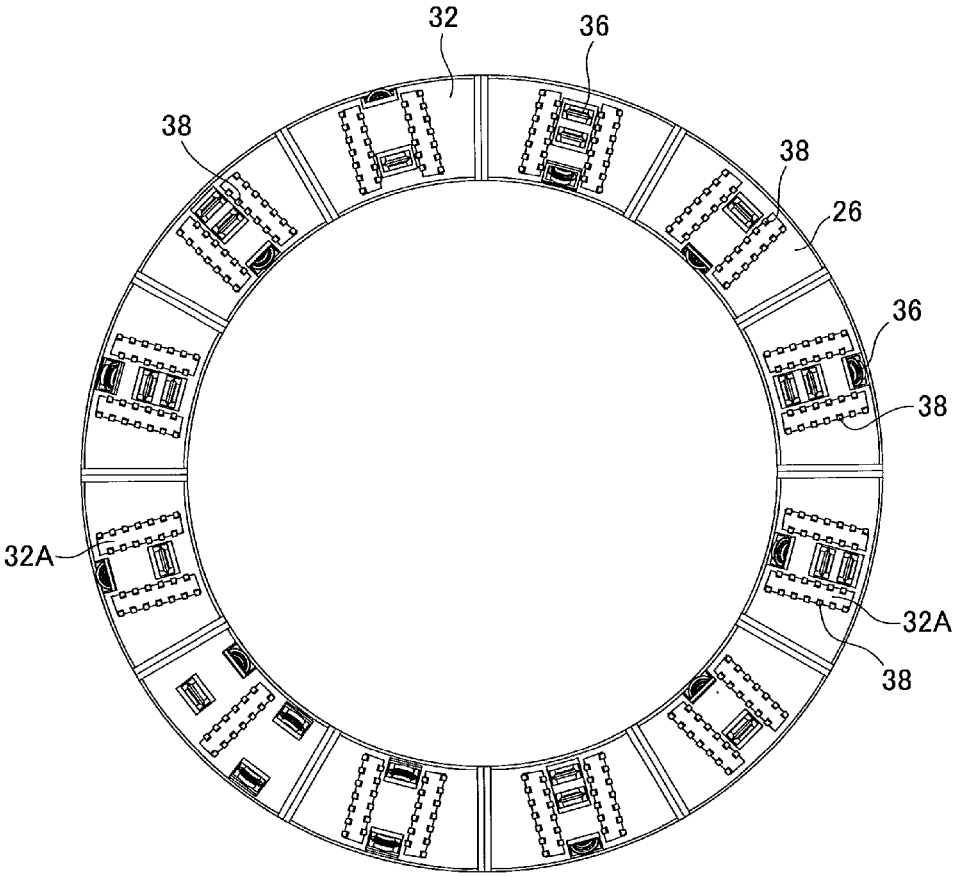
FIG. 3 is a side elevation seen along A-A in FIG. 2.
Figure 4:
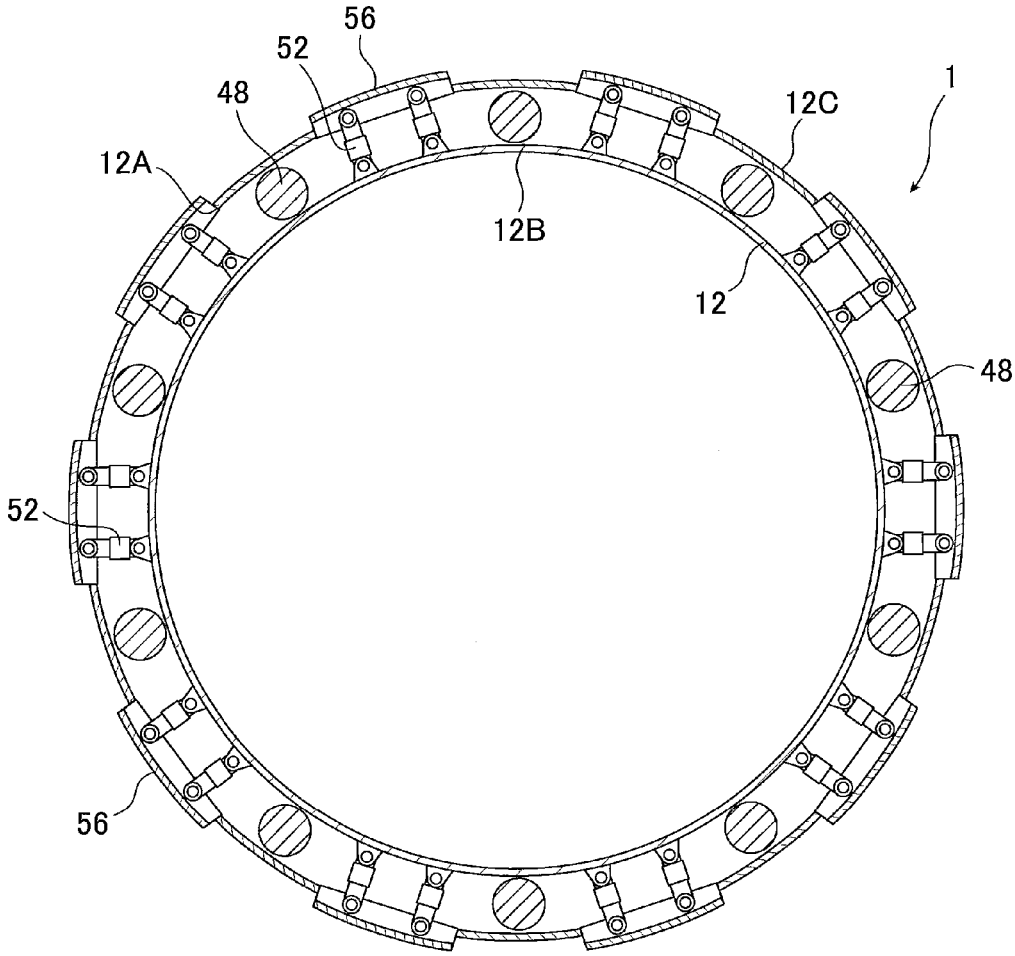
FIG. 4 is a cross section seen along B-B in FIG. 2.
Figure 5:
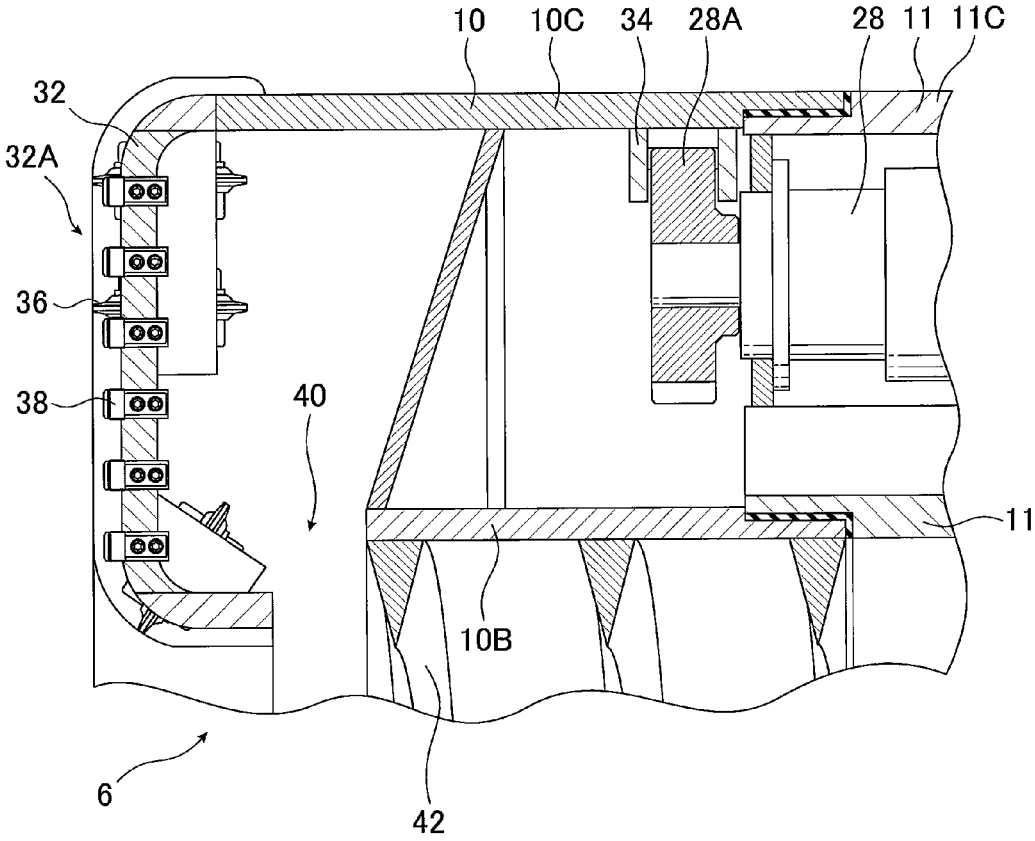
FIG. 5 is an expanded diagram of the C portion in FIG. 2.

FIG. 1 is a perspective view showing an excavating apparatus 1 according to the present embodiment; FIG. 2 is a vertical section in the direction of advancing excavation by the excavating apparatus 1 according to the present embodiment; FIG. 3 is a side elevation seen along A-A in FIG. 2; and FIG. 4 is a section seen along B-B in FIG. 2. FIG. 5 is an expanded diagram of the C portion in FIG. 2.

As shown in FIGS. 1 and 2, the excavating apparatus 1 comprises: a cylindrical shell body 2; an excavating mechanism 4 disposed on the end of the shell body 2 in the direction of advancing excavation thereof (the "front" hereafter); an excavated dirt discharge mechanism 6; and a propelling mechanism 8 for propelling the excavating mechanism 4.

As shown in FIG. 2, the shell body 2 comprises, sequentially connected from the front: a first excavating portion shell body 10; a second excavating portion shell body 11; a front shell body 12; and a rear shell body 14. Each shell body 10, 11, 12, and 14 comprises: outer cylinder bodies 10C, 11C, 12C, and 14C; inner cylinder bodies 10B, 11B, 12B, and 14B disposed inside outer cylinder bodies 10C, 11C, 12C, and 14C; and multiple support members 20, 22, and 24 disposed so as to connect inner cylinder bodies 10B, 11B, 12B, and 14B and outer cylinder bodies 10C, 11C, 12C, and 14C (first excavating portion shell body 10 support member is not shown). Inner cylinder bodies 10B, 11B, 12B, and 14B and outer cylinder bodies 10C, 11C, 12C, and 14C are respectively made of steel. Note that in the first excavating body shell body, the inner cylinder body 10B ends further back on the rear side than the outer cylinder body 10C.

These inner cylinder bodies 10B, 11B, 12B, and 14B, and outer cylinder bodies 10C, 11C, 12C, and 14C are disposed concentrically and coaxially with the rotational axis of the excavating mechanism 4 described in detail below; by this means an annular space is formed between the inner cylinder bodies 10B, 11B, 12B, and 14B and the outer cylinder bodies 10C, 11C, 12C, and 14C. The support members 20, 22, and 24 are made of rod-shaped steel, and are disposed in a number capable of supporting the ground pressure acting on the outer cylinder bodies 10C, 11C, 12C, and 14C in a radiating fashion around the center axis of the inner cylinder bodies 10B, 11B, 12B, and 14B, appropriately spaced in the circumferential and axial directions to connect these inner cylinder bodies 10B, 11B, 12B, and 14B and outer cylinder bodies 10C, 11C, 12C, and 14C. A propelling mechanism 8 is housed in the annular space between the inner cylinder bodies 10B, 11B, 12B, and 14B and the outer cylinder bodies 10C, 11C, 12C, and 14C.

The first excavating portion shell body 10 is formed to have a fixed outer diameter and inner diameter from the leading end portion to the center portion in the direction of advancing excavation, and the inner circumferential surface at the rear end portion of the inner cylinder body 10B and outer circumferential surface of the rear end portion of the outer cylinder body 10C are notched. The leading end portion of the inner circumferential surface of the second excavating portion shell body 11 inner cylinder body 11B and the leading end portion of the outer circumferential surface of the outer cylinder body 11C are also notched, and the first excavating portion shell body 10 is rotatably connected to the second excavating portion shell body 11 by housing the leading end portion of the second excavating portion shell body 11 inside the rear end portion of the first excavating portion shell body 10. Note that a member or material for improving the sliding of a bearing or the like may be interposed between the first and second excavating portion shell bodies 10 and 11.

On the second excavating portion shell body 11, the rear end portion of the inner circumferential surface of inner cylinder body 10B and the rear end portion of the outer circumferential surface of outer cylinder body 10C are notched. Also, on the front shell body 12 the rear end portion of the outer circumferential surface of inner cylinder body 12B and the rear end portion of the inner circumferential surface of outer cylinder body 12C are notched. By housing the second excavating portion shell body 11 on the inside of the leading end portion of the front shell body 12, the second excavating portion shell body 11 is connected so as to be slidable in the axial direction relative to the front shell body 12.

Similarly, on the front shell body 12, the rear end portion of the inner circumferential surface of inner cylinder body 12B and the rear end portion of the outer circumferential surface of outer cylinder body 12C are notched. Also, on the rear shell body 14, the rear end portion of the inner circumferential surface of inner cylinder body 14B and the rear end portion of the inner circumferential surface of outer cylinder body 14 are notched. By housing the rear end portion of the front shell body 12 on the inside of the leading end portion of the rear shell body 14, the front shell body 12 is connected so as to be slidable in the axial direction relative to the rear shell body 14. Note that it is also acceptable to provide a guide member to guide axial sliding at the connecting portion between second excavating portion shell body 11 and front shell body 12, and between front shell body 12 and rear shell body 14.

As shown in FIGS. 2 and 3, excavating mechanism 4 is affixed to the leading end portion of the first excavating portion shell body 10. Excavating mechanism 4 comprises: a cutter portion 26 attached to the leading end in the direction of advancing excavation of the first excavating portion shell body 10 so as to cover the area between the inner cylinder body 10B and the outer cylinder body 10C; a speed reducer 28 disposed within the excavating portion shell body 10; and a motor 30 disposed within the front shell body 12.

The cutter portion 26 comprises: a ring-shaped cutter portion main body 32; 13 pairs of roller bits 36 disposed on the cutter portion main body 32 and separated by spaces in the circumferential direction; and boring bits 38, disposed on the edge of opening 32A formed on the cutter portion main body 32. In addition, as shown in FIG. 5, a pin rack 34 is attached along the edge at the rear of the cutter portion main body 32.

As shown in FIG. 5, the cutter portion main body 32 has a U-shaped cross sectional shape in axial section, and the diameter D1 thereof is approximately equal to the outer diameter of the excavating portion shell body 10 outer cylinder body 10C. The inner diameter D3 of cutter portion main body 32 is smaller than the inner diameter D2 of the first excavating portion shell body 10 inner cylinder body 10B by exactly dx. In addition, as discussed above, in the first excavating portion shell body 10, the inner cylinder body 10B terminates further back than the outer cylinder body 10C. Given the above constitution, a gap 40 is formed between the inside rear of the cutter portion main body 32 and the inner cylinder body 10B of the first excavating portion shell body 10, and the space inside this cutter portion main body 32 and the space inside the first excavating portion shell body 10 inner cylinder body 10B communicate through this gap 40.

As shown in FIG. 5, a motor 30 is disposed inside the second excavating portion shell body 11; speed reducer 28 is connected to the rotating shaft of this motor 30, and a pinion 28A is attached to the speed reducer 28. The pinion 28A attached to the speed reducer 28 engages a pin rack 34 attached to the cutter portion 26. When the motor 30 rotates a rotary force is thus transferred to the cutter portion 26 with a torque amplified by the speed reducer 28, so that cutter portion 26 rotates relative to the second excavating portion shell body 11 about the center axis of the first excavating portion shell body 10.

Figure 6:
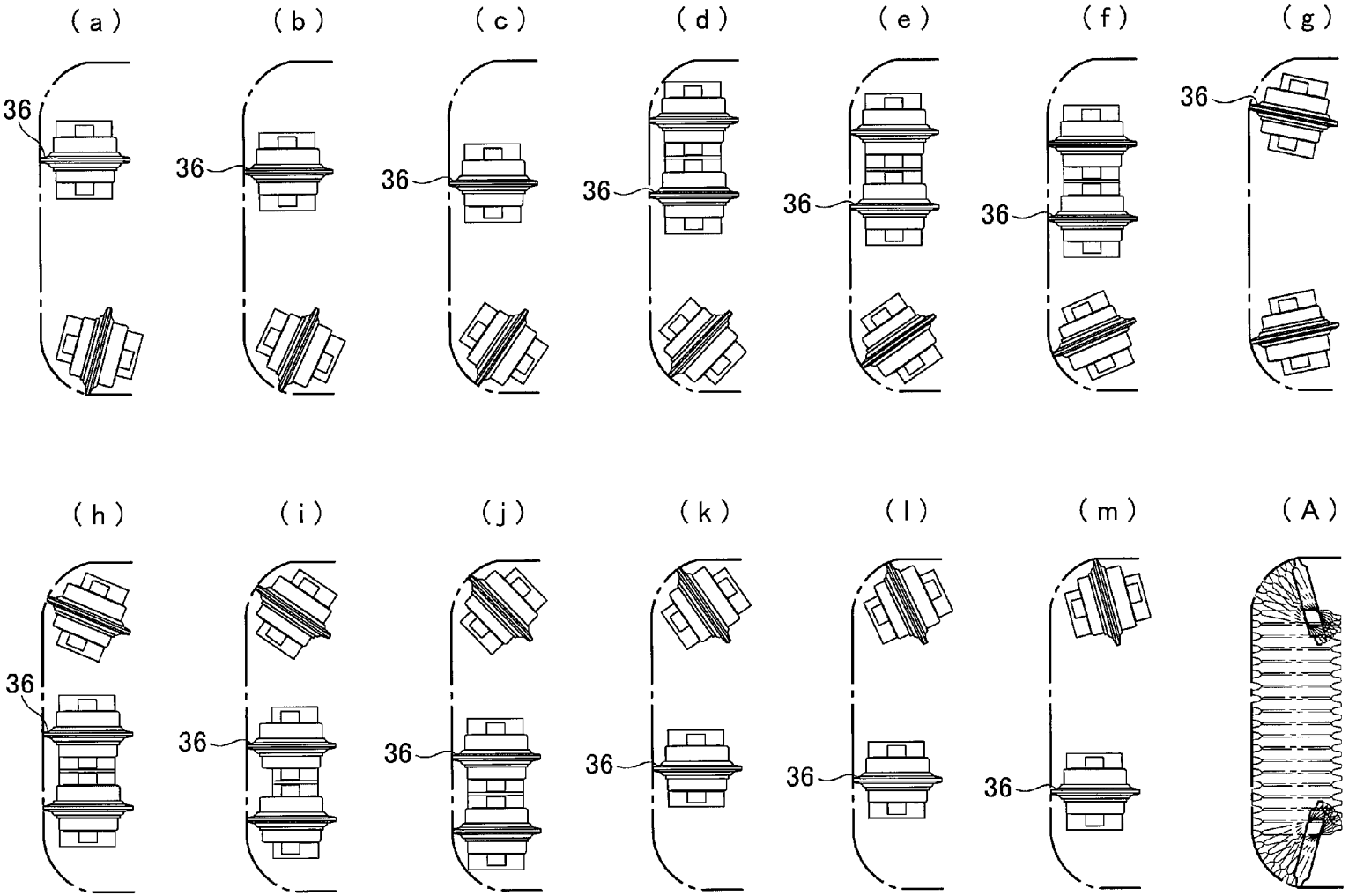
FIGS. 6(*a*) through (*m*) respectively show the disposition of multiple roller bits in the excavating apparatus shown in FIG. 1; (A) shows the roller bits in (a) through (m) in superimposition.

FIG. 6 shows the radial disposition of the respective multiple roller bits 36 attached to the cutter portion main body 32; (a) through (m) depict the radial disposition of each roller bit 36, and (A) depicts all of the roller bits in superimposition. As shown in the figure, each roller bit is disposed at a different radial position. Thus when the cutter portion 26 rotates in the circumferential direction, the trajectories traveled by each of the roller bits 36 form concentric circles approximately evenly spaced in the radial direction, making excavation uniform irrespective of diameter.

Boring bits 38 are sharp-tipped bits which, by the rotation of the cutter portion 26, excavate so that surfaces excavated by roller bits 36 are uniformly flattened.

As shown in FIG. 5, the excavated dirt discharge mechanism 6 comprises: a blade 42 constituting a screw conveyor attached along the inner circumferential surface of the inner cylinder body 10B of the first excavating portion shell body 10; and a jet nozzle (not shown) disposed so that a jetting outlet thereon is exposed on the surface of the cutter portion main body 32 to jet water toward ground. The blade 42 is made of spiral steel concentric and coaxial with the excavating apparatus 1; it is affixed to the inner circumferential surface of the inner cylinder body 10B of the first excavating portion shell body 10 in the axial direction from the rear end of the cutter portion main body 32 to the rear end of the first excavating portion shell body 10. The blade 42 forms an isosceles triangle shape in section, the height of which is approximately equal to dx, which is half the difference between the inner diameter D2 of the first excavating portion shell body 10 inner cylinder body 10B and the inner diameter D3 of the cutter portion main body 32. I.e., the distance (inner diameter) from the peak of the blade 42 to the center axis of the excavating apparatus 1 is equal to the inner diameter D3 of the cutter portion main body 32. Note that in the present embodiment, blade 42 height is approximately equal to dx, but it may also be made shorter.

As shown in FIGS. 1 and 3, the propelling mechanism 8 comprises: multiple pairs of serially connected front and rear axial hydraulic jacks 48 and 50 extending in the direction of advancing excavation; multiple front and rear radial hydraulic jacks 52 and 54 disposed between circumferentially adjacent axial hydraulic jacks 48 and 50; and multiple support plates 56 and 58, respectively connected to front and rear radial hydraulic jacks 52 and 54.

Each pair of front and rear axial hydraulic jacks 48 and 50 is serially connected to extend in the direction of advancing excavation. In the present embodiment 10 pairs of the front and rear axial hydraulic jack 48 and 50 in each pair are disposed at equal angle spacing in the shell body 2 circumferential direction so that uniform propulsion force is obtained regardless of angle.

Front and rear hydraulic jacks 48 are housed between the inner cylinder bodies 11B, 12B and outer cylinder bodies 11C, 12C from the second excavating portion shell body 11 to the front shell body 12; the leading end is affixed to the second excavating portion shell body 11 support member 20 and the rear tip is affixed to front shell body 12 support member 22.

A rear hydraulic jack 50 is housed between inner cylinder bodies 12B, 14B and outer cylinder bodies 12C, 14C from front shell body 12 to rear shell body 14; the leading end is affixed to the support member 22 of the front shell body 12 and the rear tip is affixed to the support member 24 of the rear shell body 14. Thus front and rear hydraulic jacks 48 and 50 are serially connected via support member 22.

Front and rear radial hydraulic jacks 52 and 54 are disposed at positions corresponding to the four corners of support plates 56, 58 as a set of four hydraulic jack units relative to rectangular support plates 56, 58. The paired front and rear radial hydraulic jacks 52, 54 are respectively housed in the front shell body 12 and rear shell body 14, separated by a space in the excavation advancing direction. In the present embodiment, the front and rear radial hydraulic jacks 52, 54 are respectively disposed at equal angle spacing in the circumferential direction so that uniform ground reaction force is obtained regardless of angle.

Formed on front and rear front shell body 12 and 14 outer cylinder bodies 12B and 14B are openings 12A and 14A at positions corresponding to front and rear radial hydraulic jacks 52 and 54. The front and rear radial hydraulic jacks 52 and 54 are affixed at one end to front and rear shell body 12 and 14 inner cylinder bodies 12B and 14B, and at the other end to support plates 56 and 58 having approximately the same shape as the openings 12A and 14A formed on outer cylinder body 18. In this constitution, extension of the radial hydraulic jacks 52 and 54 causes support plates 56 and 58 to project outward toward the outer perimeter.

Note that these axial hydraulic jacks 48 and 50 and radial hydraulic jacks 52 and 54 are connected to a control device (not shown), and hydraulic pressure is supplied from the control device.

Below we explain a tunnel excavation method using the above-described excavating apparatus 1.

Figure 7:
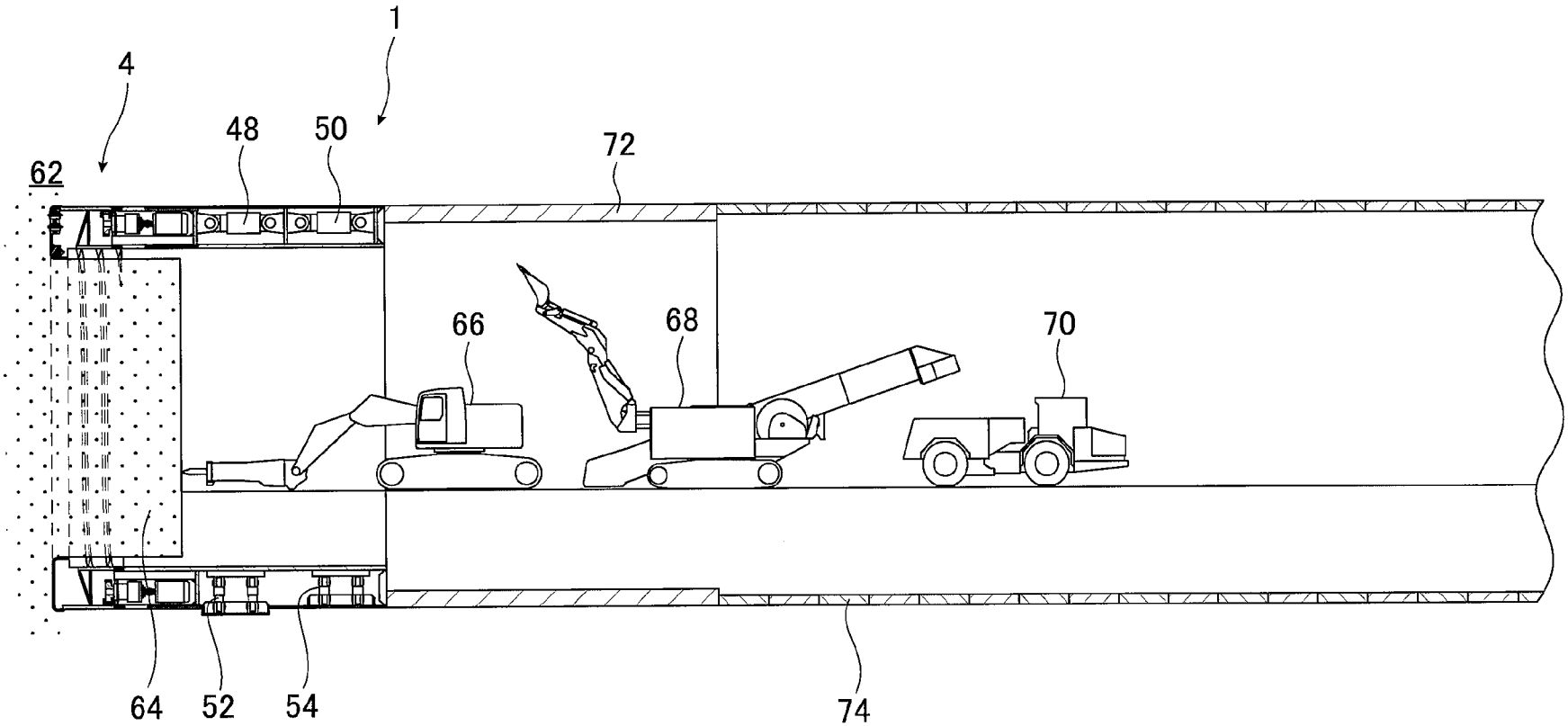
FIG. 7 is a vertical section in the direction of advancing excavation, for the purpose of explaining a tunnel excavation method using the excavating apparatus shown in FIG. 1.

FIG. 7 is a vertical cross section showing tunnel excavation using an excavating apparatus 1 according to the present embodiment. As shown in that figure, in the present embodiment a tunnel with a circular cross section is constructed by a forward excavation of ground 62 in a cylindrical shape using excavating apparatus 1, followed by excavation of ground 64 in the remaining center portion using heavy equipment.

Figure 8:
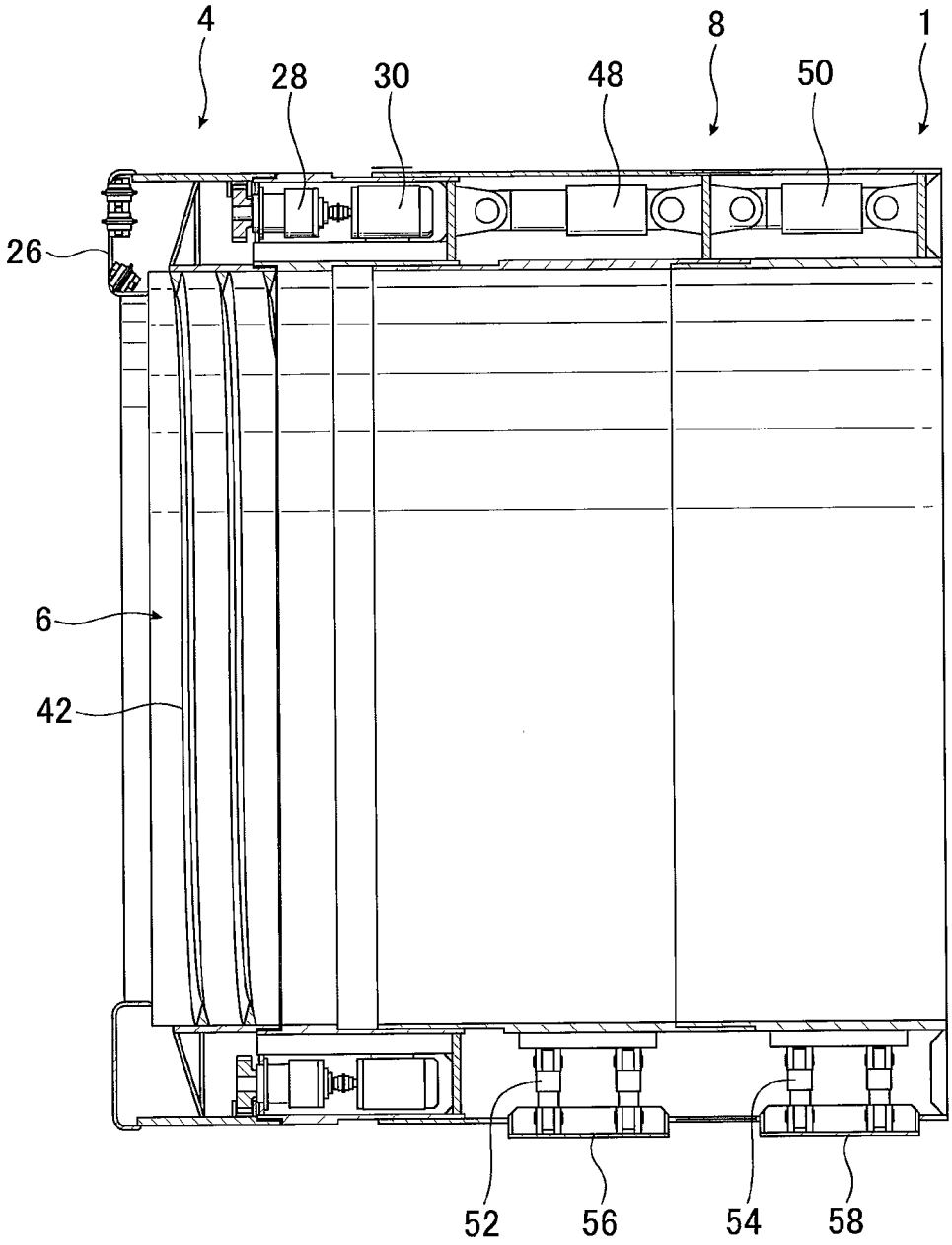
FIG. 8 is a vertical section (No. 1) of an excavating apparatus, for the purpose of explaining a method for propelling the excavating apparatus shown in FIG. 1.
Figure 9:
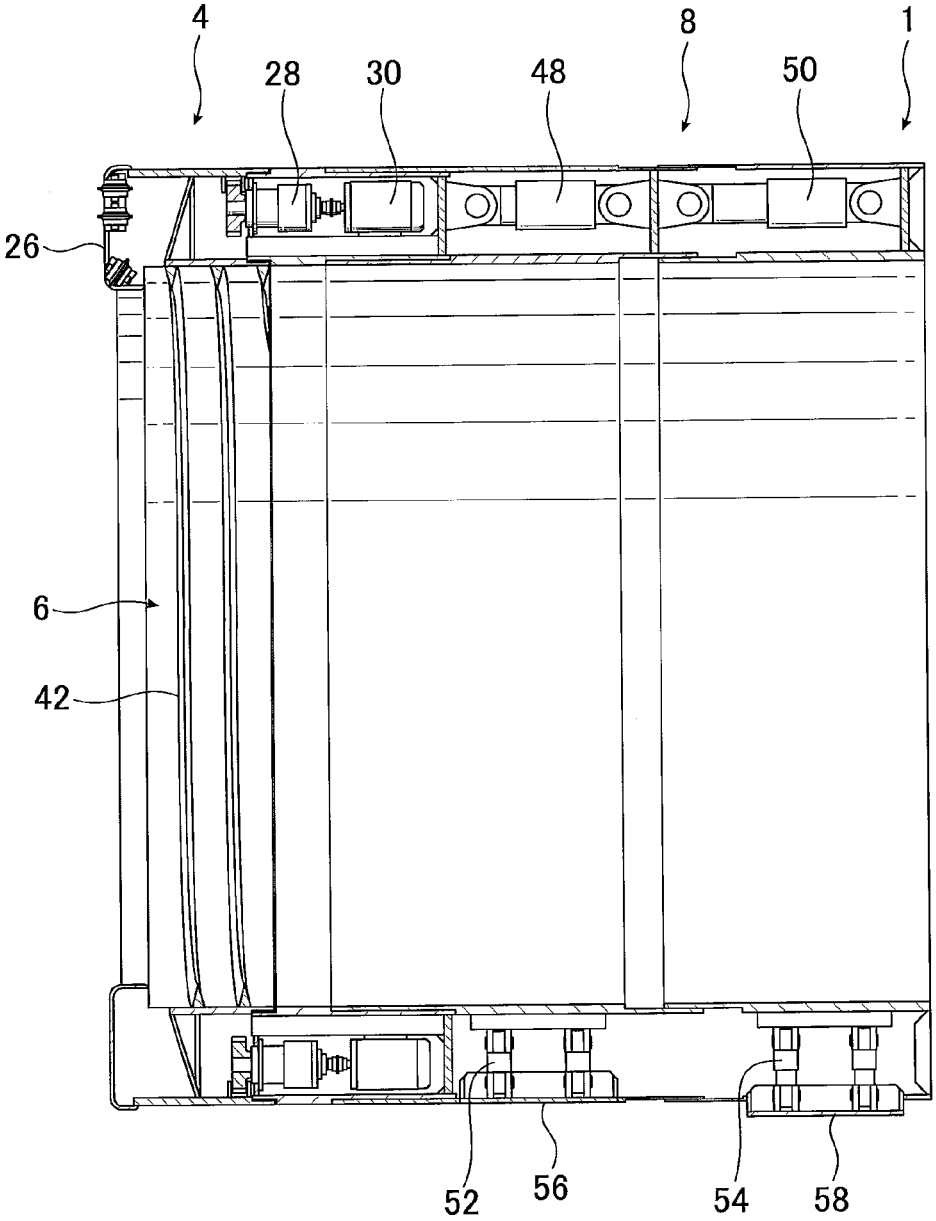
FIG. 9 is a vertical section (No. 2) of the excavating apparatus, for the purpose of explaining a method for propelling the excavating apparatus shown in FIG. 1.
Figure 10:
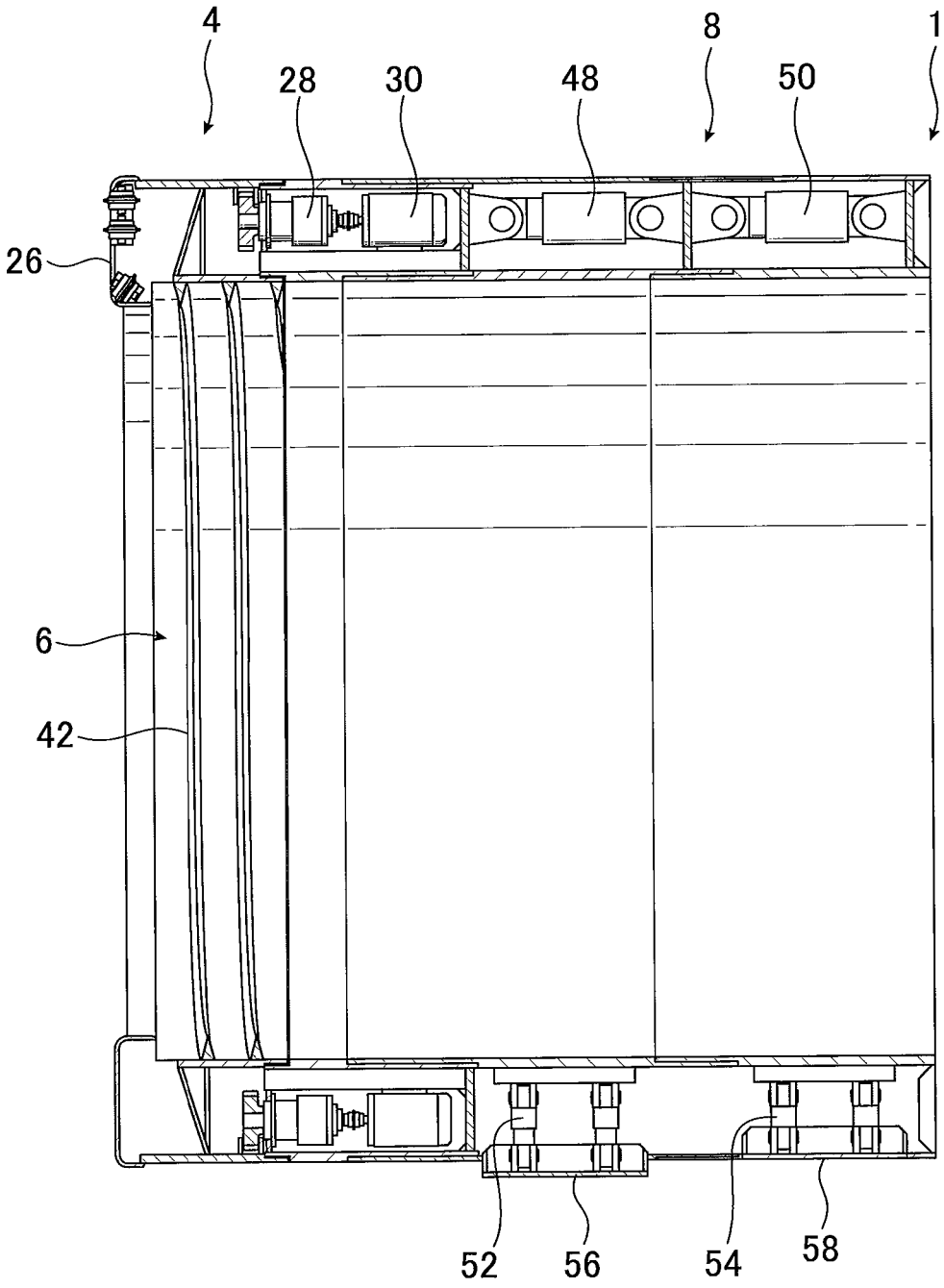
FIG. 10 is a vertical section (No. 3) of the excavating apparatus, for the purpose of explaining a method for propelling the excavating apparatus shown in FIG. 1.

First, referring to FIGS. 8 through 10, we discuss a method for propelling excavating mechanism 4 using propelling mechanism 8. Note that the propelling operation is accomplished by rotating the excavating mechanism 4 cutter portion 26 about the axis of the excavating apparatus 1 and discharging excavated dirt using excavated dirt discharge mechanism 6.

First, as shown in FIG. 8, the front and rear radial hydraulic jacks 52 and 54 are extended with the front and rear axial hydraulic jacks 48 and 50 in a contracted state so that surrounding ground is pressed by the support plates 56 and 58. With reaction force obtained from the ground using support plates 56 and 58, the front axial hydraulic jack 48 is extended to push the excavating mechanism 4 forward, and ground is excavated in a cylindrical shape by the excavating mechanism 4.

In this manner, as shown in FIG. 9, once excavation has been carried out over a predetermined distance, the front radial hydraulic jack 52 is caused to contract and ground is pressed by the rear support plate 58 alone. The front axial hydraulic jack 48 is then caused to contract and the rear axial hydraulic jack 50 is extended at that same speed. This enables the front shell body 12 to be advanced while maintaining the position of the excavating mechanism 4.

Next, as shown in FIG. 10, the front radial hydraulic jack 52 is extended and ground is pressed by the front support plate 56, while the rear radial hydraulic jack 54 is caused to contract. The rear axial hydraulic jack 50 is then caused to contract. This enables the rear shell body 14 to be advanced while maintaining the position of the excavating mechanism 4 and the front shell body 12.

By repeating the aforementioned steps, the excavating mechanism 4 can be made to advance forward and the excavating apparatus 1 can be propelled.

In addition to the aforementioned propelling operation, the cutter portion 26 is rotated to excavate ground and the excavated dirt thus excavated is fed to rear of the apparatus.

I.e., the motor 30 of the excavating mechanism 4 is rotated with the cutter portion 26 pushed against the ground by the propelling mechanism 8. The rotary force of the motor 30 is transferred to speed reducer 28 where torque is amplified, and cutter portion 26 is rotated via pinion 60 and pin rack 34. When the cutter portion 26 rotates, ground is first excavated in a saw-tooth sectional shape by roller bits 36, then surface unevenness is ground off using boring bits 38. This enables ground to be excavated in an annular shape.

When the cutter portion 26 rotates, the blade 42 also rotates together therewith. Excavated dirt produced by excavation of ground by the cutter portion 26 is mixed with water jetted from the jet nozzle to improve its fluidity. Excavated dirt is then directed from the opening 32A formed in cutter portion main body 32 into the annular space within the excavating portion shell body 10 and discharged from the rear opening 40 of the first excavating portion shell body 10. Excavated dirt discharged from the rear of the first excavating portion shell body 10 is fed to the annular space between the inner cylindrical body 10B of the first excavating portion shell body 10 and the ground left as a columnar shape therein at the time of annular excavation. Excavated dirt fed between the inner cylindrical body 10B and the columnar remaining ground is fed toward the rear of the apparatus along the inner circumferential surface of the inner cylindrical body 10B of the first excavating portion shell body 10 by the spiral blade 42 which rotates together with the cutter portion 26. At this point, the distance (inner diameter) from the peak of the blade 42 to the center axis of the excavating apparatus 1 is equal to the inner diameter of the cutter portion main body 32, therefore no gap is formed between the leading end of the blade 42 and the ground left in an annular shape, and dirt can be reliably transported.

If at this point clogging of blade 42 occurs, blade 42 can be exposed by excavating the ring-shaped residual dirt left on the inside of the excavating apparatus 1, and the clogging can be easily removed.

Behind the excavating apparatus 1, a temporary protection plate 72 is attached to the inner circumferential surface of the annularly excavated tunnel.

In parallel to the forward excavation work above, ground 64 on the inside of the part excavated in a ring shape by the excavating apparatus 1 is excavated up to a position behind the first excavating portion shell body 10. This excavating work may be done using a breaker 66 or heavy equipment such as a backhoe or the like.

Excavated dirt resulting from the excavation of excavated dirt and ground moved by the blade is loaded onto a dump truck 70 by a Schaeff loader 68 and conveyed outside the tunnel.

Next, in the part of the total tunnel cross section in which excavation is completed, temporary protection plate 72 is removed from the inner circumferential surface of the tunnel, and lining using segment 74 or the like is installed.

A circular section tunnel can be constructed using the steps above.

Using the present embodiment, a spiral blade 42 is attached to the inner circumferential surface of the inner cylindrical body 10B of the first excavating portion shell body 10 as an excavated dirt discharge mechanism 6, thus ensuring space for discharging large sectional area excavated dirt and permitting the transport of large volumes of excavated dirt.

Also, because the blade 42 is attached to the inner circumferential surface of the first excavating portion shell body 10 inner cylindrical body 10B, even if clogging should occur dirt can be easily eliminated by removing dirt remaining on the inside of the first excavating portion shell body 10.

In addition, in the present embodiment excavated dirt can be transported by the rotation of the cutter portion 26, therefore no separate drive force is required apart from the drive force for turning the cutter portion 26.

Note that in the present embodiment only one spiral blade 42 is provided on the first excavating portion shell body 10 inner cylindrical body 10B, but the invention is not limited thereto, and multiple spiral blades may also be provided.

Furthermore, the embodiment above provided front and rear axial hydraulic jacks 48 and 50, but the invention is not limited thereto, and it is also acceptable to provide only one axial hydraulic jack.

Second Embodiment

Below we discuss a second embodiment of the present invention.

In the present embodiment, it is primarily the constitution of the propelling mechanism which differs from the first embodiment. Note that in the explanation of the present embodiment, elements in common with the first embodiment are given the same reference numerals and explanations thereof are omitted.

Figure 11:
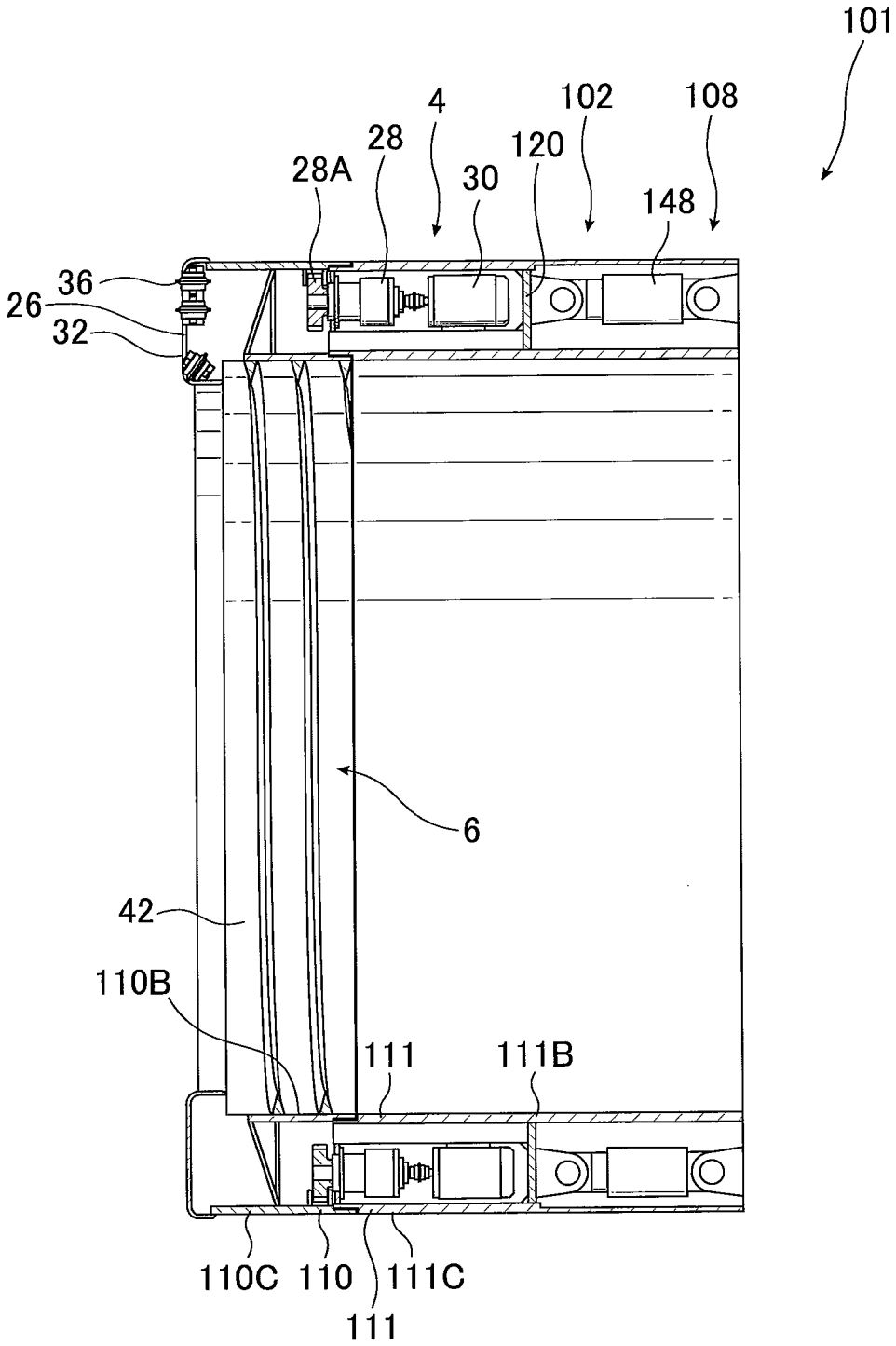
FIG. 11 is a vertical section along the direction of advancing excavation of an excavating apparatus according to a second embodiment of the present invention.

FIG. 11 is a vertical cross section showing the constitution of an excavating apparatus having a propelling mechanism different from that of the first embodiment. As shown in that figure, an excavating apparatus 101 comprises: a cylindrical shell body 102, an excavating mechanism 4 disposed on the leading end of the shell body 102, an excavated dirt discharge mechanism 6, and a propelling mechanism 108 connected to the rear of the excavating mechanism 4.

In the present embodiment, the shell body 102 comprises: a first shell body 110 and a second shell body 111, sequentially connected from the front. The first and second shell bodies 110 and 111 are respectively constituted by cylindrical outer cylinder bodies 110C and 111C, inner cylinder bodies 110B and 111B disposed within outer cylinder bodies 110C and 111C, and multiple support members 120 disposed to connect inner cylinder bodies 110B, 111B and outer cylinder bodies 110C, 111C.

These inner cylinder bodies 110B, 111B and outer cylinder bodies 110C, 111C are disposed concentrically and coaxially with the rotating axis of excavating mechanism 4, such that an annular space is formed between inner cylinder bodies 110B, 111B and outer cylinder bodies 110C, 111C. Support members 120 are made of rod-shaped steel, and are arrayed radially about the center axis of the inner cylinder bodies 110B, 111B in a number capable of supporting the ground pressure acting on outer cylinder bodies 110C, 111C, and spaced appropriately in the circumferential and axial direction, connecting these inner cylinder bodies 110B, 111B and outer cylinder bodies 110C, 111C. The excavating mechanism 4 speed reducer 28, motor 30, and propelling mechanism 108 are housed within the annular space between the inner cylinder bodies 110B, 111B and outer cylinder bodies 110C, 111C.

A propelling mechanism 108 is constituted by multiple axial hydraulic jacks 148 extending in the direction of advancing excavation. In the present embodiment, 10 axial hydraulic jacks 148 are disposed at equal angle spacing in the shell body 102 circumferential direction so that uniform propulsion force is obtained regardless of angle. The axial hydraulic jacks 148 are affixed at the leading end to the second excavating portion shell body 111 support members 120. Note that, although not shown, the axial hydraulic jacks 148 are supported on the shell body 111 by an appropriate support means so as to be maintained in a parallel orientation to the axial direction of the excavating apparatus 101 when the axial hydraulic jacks 148 extends and contracts.

In the present embodiment the propelling mechanism is propelled by extension of the axial hydraulic jacks with reaction force obtained from segments affixed to the inner circumference of a tunnel in which excavation has been completed. In parallel with this excavating work, as in the first embodiment, the cutter portion 26 the excavating mechanism 4 is rotated about the axis of the excavating apparatus 1 and excavated dirt is discharged by the excavated dirt discharge mechanism 6.

The same effect as in the first embodiment can also be obtained using the second embodiment excavating apparatus described above.

In addition, the overall length of the excavating apparatus can be shortened using the present embodiment.

Third Embodiment

Below, referring to figures, we discuss details of the excavating apparatus and excavating method constituting the third embodiment of the present invention. In the present embodiment, it is primarily the constitution of the excavated dirt discharge mechanism which differs from the first embodiment and the second embodiment.

Figure 12:
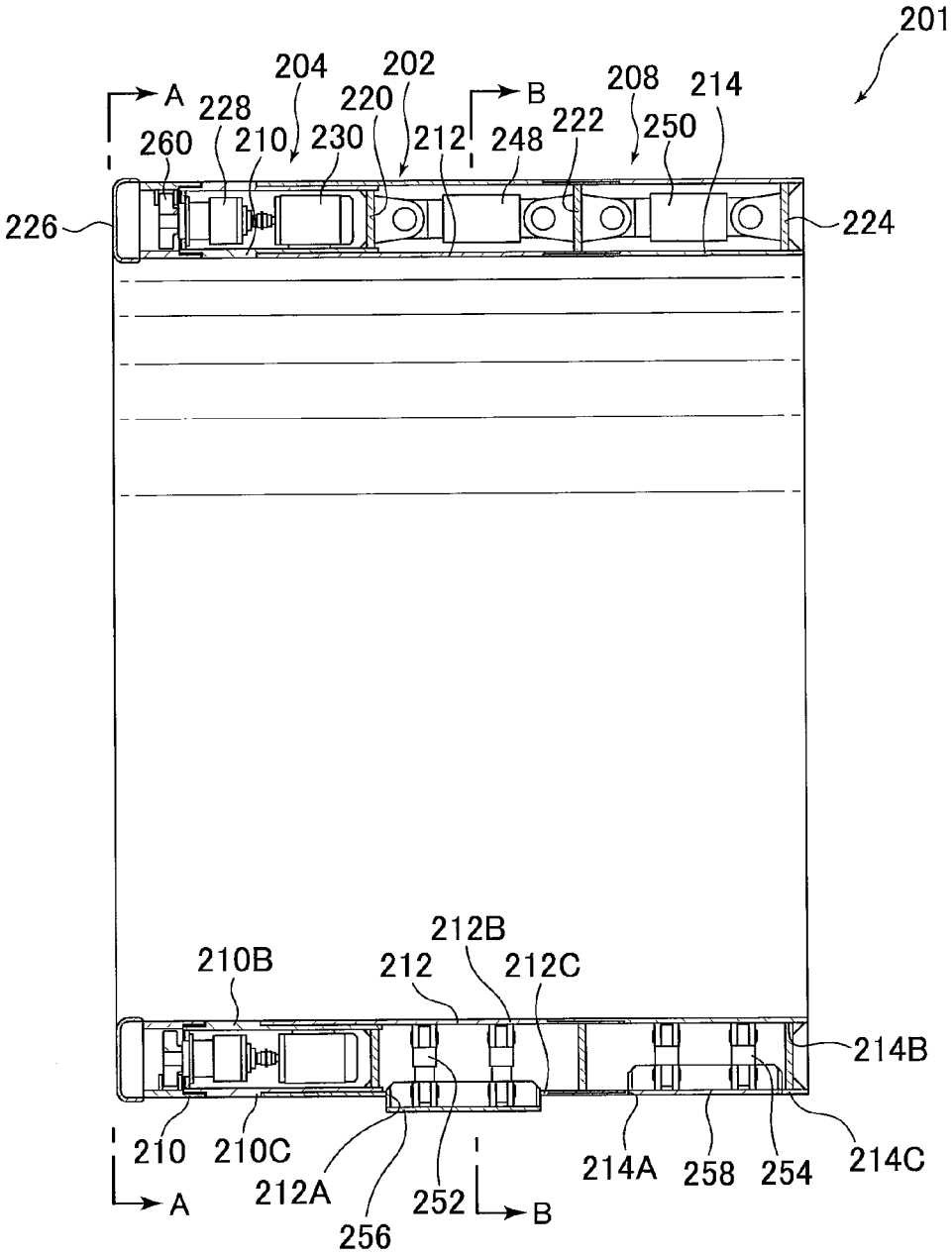
FIG. 12 is a vertical section along the direction of advancing excavation of an excavating apparatus according to a third embodiment of the present invention.
Figure 13:
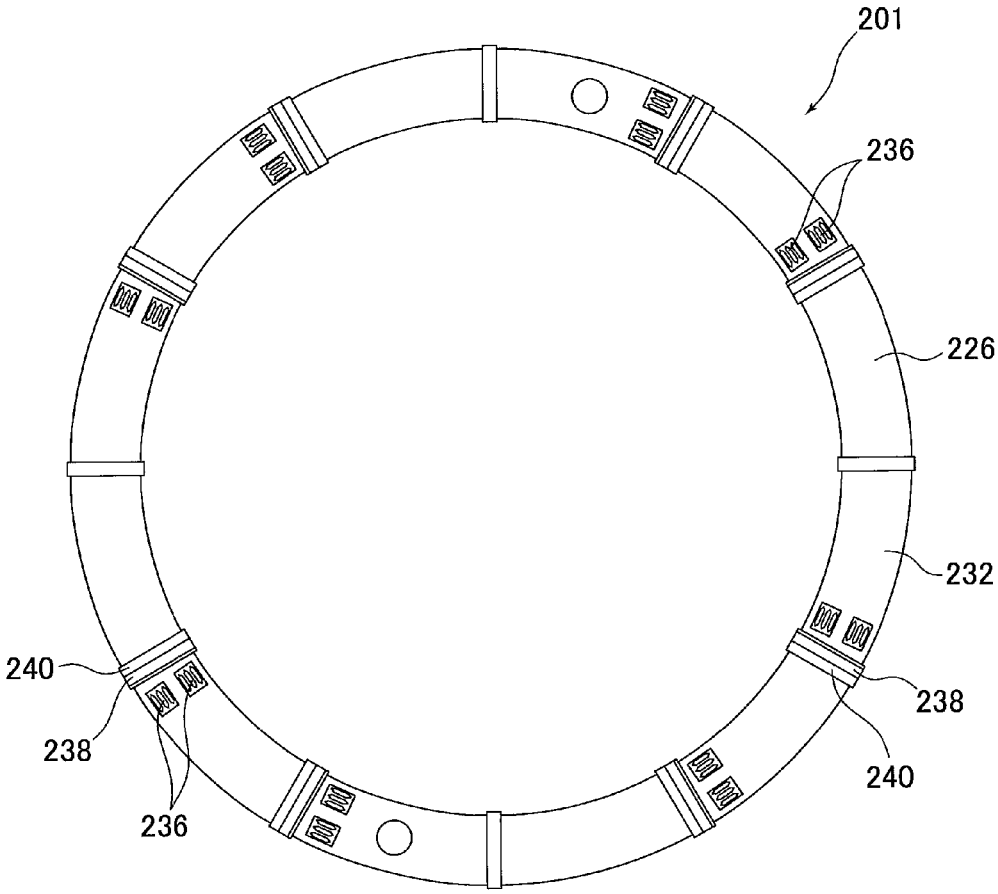
FIG. 13 is a side elevation seen along A-A in FIG. 12.
Figure 14:
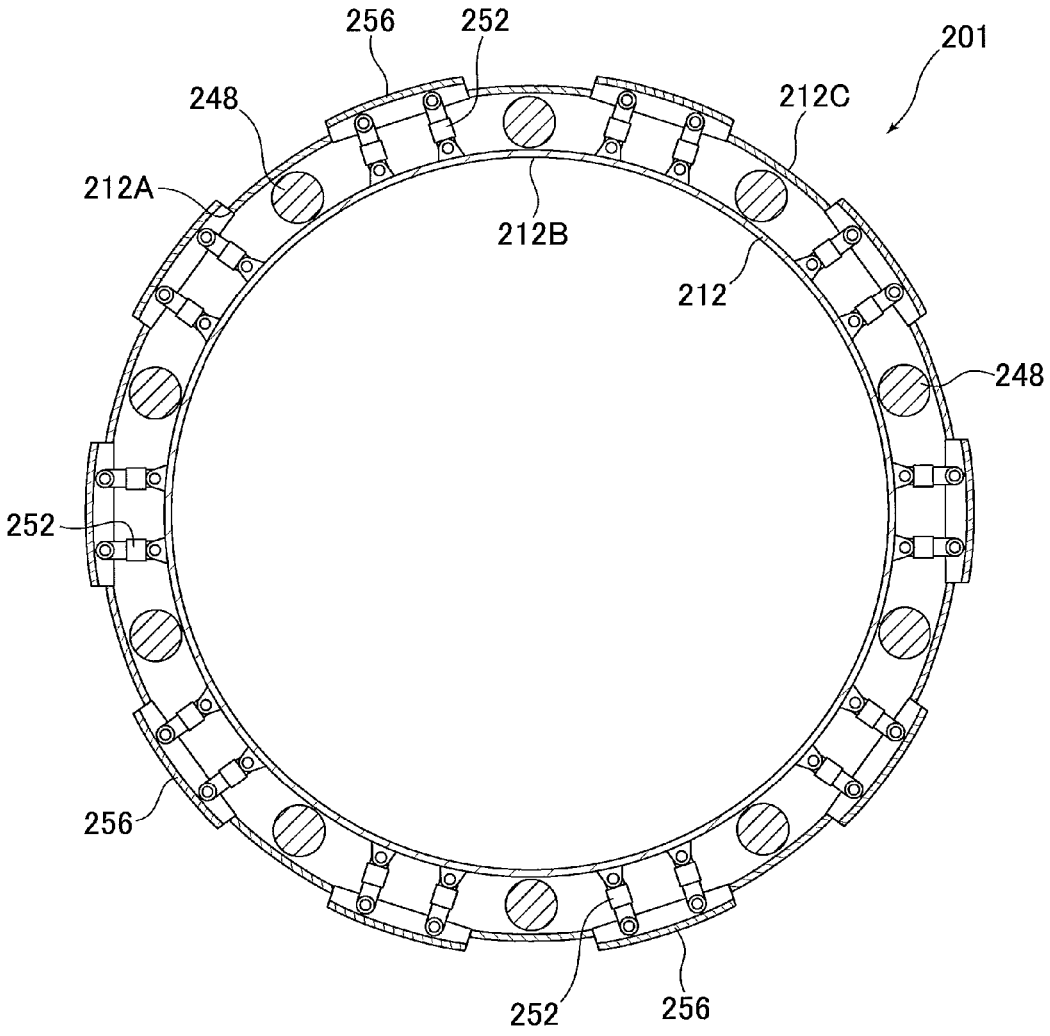
FIG. 14 is a cross section seen along B-B in FIG. 12.
Figure 15:
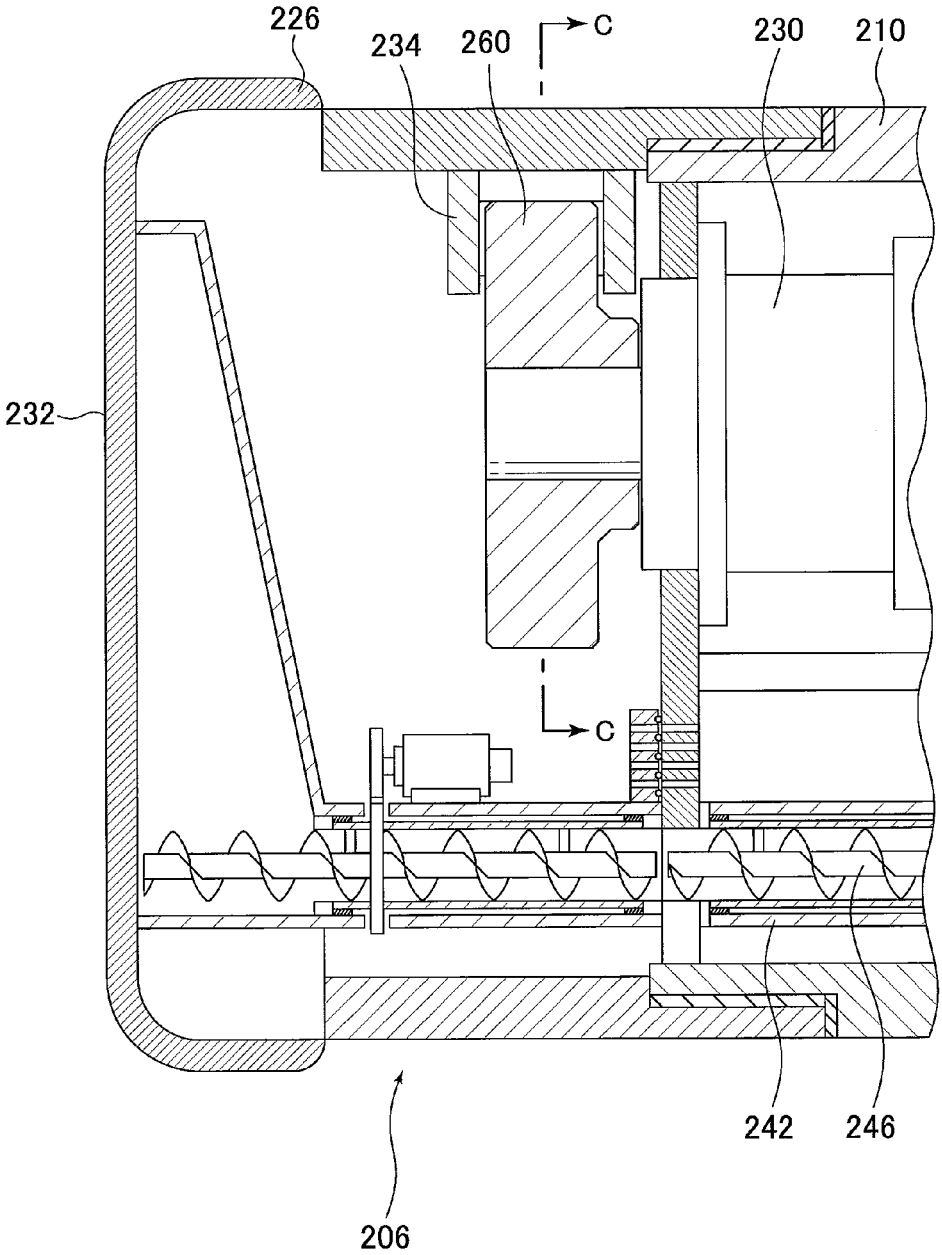
FIG. 15 is an expanded cross section along the direction of advancing excavation of the leading end portion of the excavating mechanism in an excavating apparatus according to an embodiment of the present invention.
Figure 16:
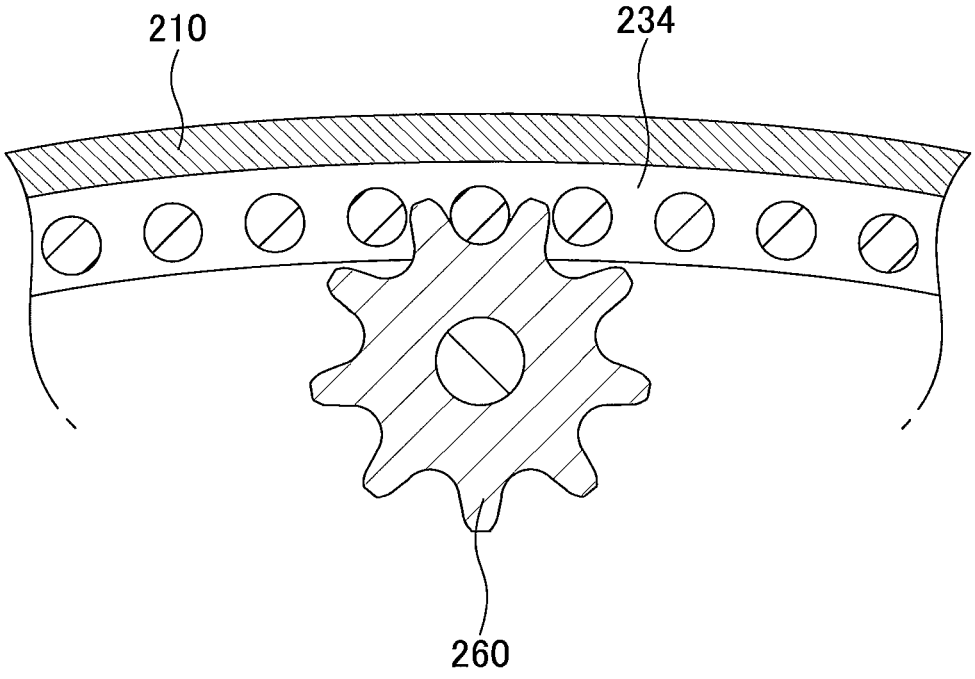
FIG. 16 is a cross section seen along C-C in FIG. 15.

FIG. 12 is a vertical section in the direction of advancing excavation by the excavating apparatus 1 according to the present embodiment; FIG. 13 is a side elevation seen along A-A in FIG. 12; and FIG. 14 is a section seen along B-B in FIG. 13. FIG. 15 is an expanded section of the leading end portion of an excavating apparatus 201 excavating mechanism 204; FIG. 16 is a cross section through C-C in FIG. 15.

As shown in FIGS. 12 and 15, the excavating apparatus 201 comprises: a cylindrical shell body 202; an excavating mechanism 204 disposed on the end of shell body 2 in the direction of advancing excavation thereof (the "front" hereafter); an excavated dirt discharge mechanism 206; and a propelling mechanism 8 for propelling excavating mechanism 204.

The shell body 2 comprises: an excavating portion shell body 210; a front shell body 212; and a rear shell body 214 connected sequentially from the leading end in the advancing direction of excavation. Each shell body 210, 212, and 214 comprises: inner cylinder bodies 210B, 212B, and 214B made of cylindrically formed steel; an outer cylinder body 218 with a larger diameter than the inner cylinder bodies 210B, 212B, and 214B disposed concentrically and coaxially and made of steel; and multiple support members 220, 222, and 224 disposed to connect between these inner cylinder bodies 210B, 212B, and 214B and outer cylinder bodies 210C, 212C, and 214C, holding the spacing between these inner cylinder bodies 210B, 212B, and 214B and outer cylinder bodies 210C, 212C, and 214C. In this constitution, an annular space is formed between the inner cylinder bodies 210B, 212B, 214B and the outer cylinder body 218, and the excavating mechanism 204, excavated dirt discharge mechanism 206, and propelling mechanism 208 are housed within this annular space.

The excavating portion shell body 210 is formed to have a predetermined diameter from the leading end to the mid-portion; the rear end is formed with a smaller diameter than the mid-portion, and this small diameter portion is housed within the leading end of the front shell body 212. Similarly, the front shell body 212 is formed to have a predetermined diameter from the leading end to the mid-portion; the rear end is formed with a smaller diameter than the mid-portion, and this small diameter portion is housed within the leading end of the rear shell body 214.

Support members 220, 222, and 224 are made of rod-shaped steel, and are arrayed radially about the center axis of the inner cylinder body 216 in a number capable of supporting the ground pressure acting on outer cylinder body 218, and spaced appropriately in the circumferential and axial direction.

As shown in FIG. 12, the excavating mechanism 204 is housed in the leading end of the excavating portion shell body 210, and comprises: a cutter portion 226; a speed reducer 228; and a motor 230 disposed at the leading end of the excavating portion shell body 210.As shown in FIGS. 13 and 15, the cutter portion 226 is annular, and comprises: a cutter portion main body 232 having a U-shaped section; an annular pin rack 234 disposed along the edge of the rear side of the cutter portion main body 232; roller bits 236 spaced apart in the circumferential direction on the cutter portion main body 232; and intake hole 238 and scraper 240 disposed circumferentially behind the roller bits 236.

A speed reducer 228 is connected to the rotary shaft of motor 230, and a pinion 260 is attached to this speed reducer 228. As shown in FIG. 16, speed reducer 228 pinion 260 meshes with the pin rack 234 of the cutter portion 226. Thus when the motor 230 rotates, this rotary force is transferred to the cutter portion 226 with torque amplified via speed reducer 228, and cutter portion 226 is rotated with a large force.

As shown in FIG. 13, an intake hole 238 is formed to extend over the width direction of the cutter portion main body 232. Intake hole 238 communicates with an excavated dirt discharge pipe 242 forming an excavated dirt discharge mechanism 206, and excavated dirt taken in from intake hole 238 is fed to excavated dirt discharge pipe 242. Roller bits 236 and scraper 240 are attached to cutter portion main body 232 so as to be able to excavate ground when the cutter portion 226 is rotated in the circumferential direction.

As shown in FIG. 15, the excavated dirt discharge mechanism 206 comprises: multiple excavated dirt discharge pipes 242 spaced apart in the circumferential direction within the shell body 202; a screw feeder 246 disposed within the excavated dirt discharge pipe 242; and a jet nozzle (not shown) for jetting water toward the ground. Excavated dirt resulting from excavation of ground is mixed with the jetted water from the jet nozzle, moved through the intake hole 238 by rotation of the cutter portion 226, and transported through the excavated dirt discharge pipe 242 by rotation of the screw feeder 246 to the rear of the excavator.

As shown in FIGS. 12 and 14, the propelling mechanism 208 comprises: multiple pairs of serially connected front and rear axial hydraulic jacks 248 and 250 extending in the direction of advancing excavation; multiple front and rear radial hydraulic jacks 252 and 254 disposed between circumferentially adjacent axial hydraulic jacks 248 and 250; and multiple support plates 256 and 258, respectively connected to front and rear radial hydraulic jacks 252 and 254.

Each pair of front and rear axial hydraulic jacks 248 and 250 is serially connected to extend in the direction of advancing excavation. In the present embodiment, 10 pairs of each pair of front and rear axial hydraulic jack 248 and 250 are disposed at approximately equal spacing in the shell body 202 circumferential direction so that uniform propulsion force is obtained regardless of angle.

Front and rear hydraulic jacks 248 are housed between the inner cylinder bodies 210B, 212B and outer cylinder bodies 210C, 212C from the excavating portion shell body 210 to the front shell body 212; the leading end is affixed to the support member 220 of the second excavating portion shell body 210 and the rear tip is affixed to the support member 222 of the front shell body 212.

A rear hydraulic jack 250 is housed between inner cylinder bodies 212B, 214B and outer cylinder bodies 212C, 214C from front shell body 212 to rear shell body 214; the leading end is affixed to the front the support member 222 of the shell body 212 and the rear tip is affixed to the support member 224 of the rear shell body 214. Thus, the front and rear hydraulic jacks 248 and 250 are serially connected via support member 222.

Front and rear radial hydraulic jacks 252 and 254 are disposed at positions corresponding to the four corners of support plates 256, 258 as a set of 4 hydraulic jack units relative to rectangular support plates 256, 258. The paired front and rear radial hydraulic jacks 252, 254 are respectively housed in the front shell body 212 and rear shell body 214, separated by a space in the advancing direction of excavation. In the present embodiment the front and rear radial hydraulic jacks 252, 254 are respectively disposed at equal angle spacing in the circumferential direction so that uniform ground reaction force is obtained regardless of angle.

Formed on the outer cylinder bodies 212B and 214B of the front and rear front shell body 212 and 214 are openings 212A and 214A at positions corresponding to the front and rear radial hydraulic jacks 252 and 254. The front and rear radial hydraulic jacks 252 and 254 are affixed at one end to the inner cylinder bodies 212B and 214B of the front and rear shell body 212 and 214, and at the other end to support plates 256 and 258, which have approximately the same shape as the openings 212A and 214A formed on outer cylinder body 218. In this constitution, extension of the radial hydraulic jacks 252 and 254 causes support plates 256 and 258 to project outward toward the outer perimeter.

Note that these axial hydraulic jacks 248 and 250 and radial hydraulic jacks 252 and 254 are connected to a control device (not shown), and hydraulic pressure is supplied from the control device.

Below we explain a tunnel excavation method using the above-described excavating apparatus 201.

Figure 17:
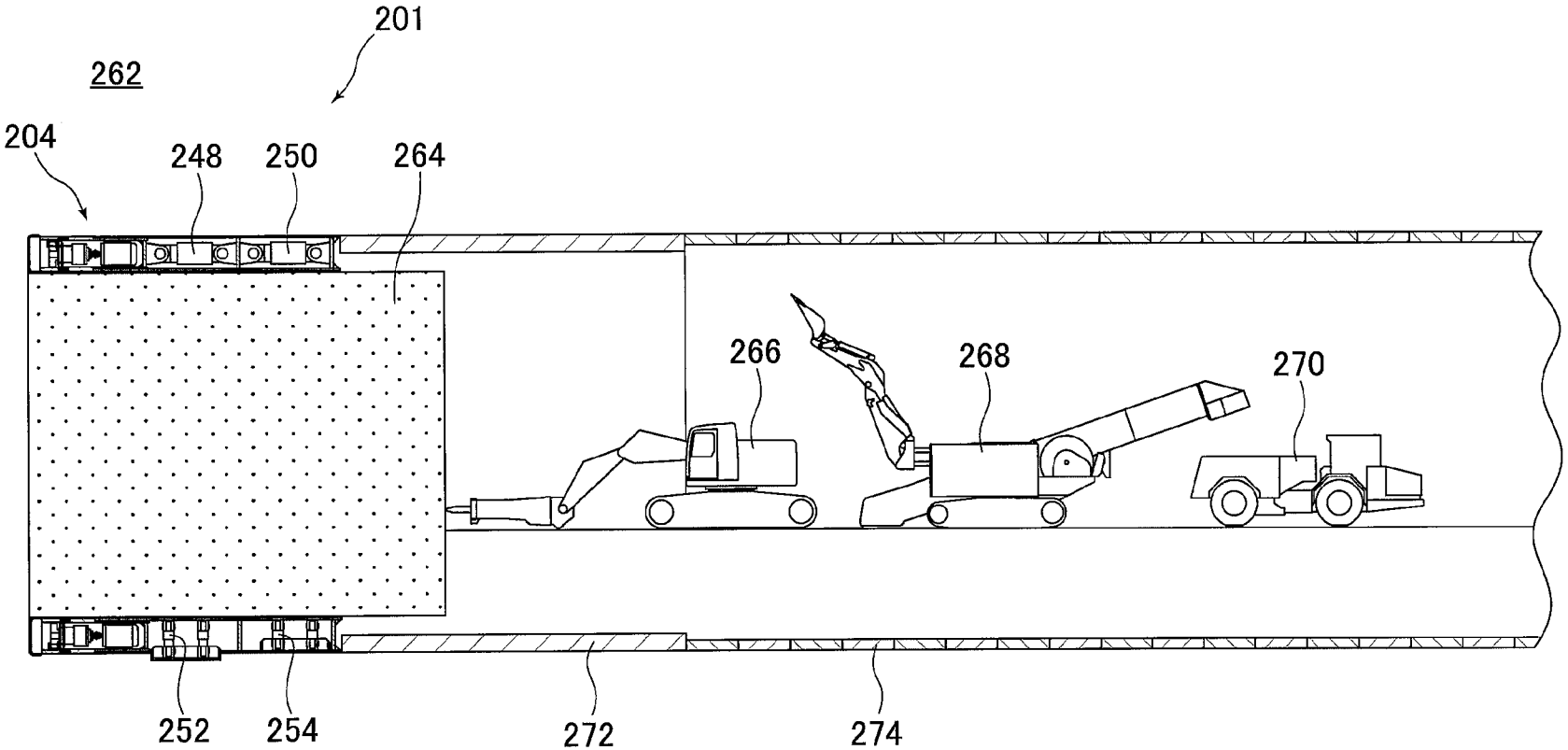
FIG. 17 is a vertical section in the direction of advancing excavation, for the purpose of explaining a tunnel excavation method using the excavating apparatus according to a third embodiment of the present invention.

FIG. 17 is a vertical cross section showing tunnel excavation using an excavating apparatus 201 according to the present embodiment. As shown in that figure, in the present embodiment a tunnel with a circular cross section is constructed by forward excavation of ground 262 in a cylindrical shape using excavating apparatus 201, followed by excavation of ground 264 in the remaining center portion using heavy equipment.

When excavating using excavating apparatus 201, excavated dirt is discharged to the outside by excavated dirt discharge mechanism 206 at the same time as ground 264 is excavated by excavating mechanism 204, while excavating mechanism 204 is pushed in the direction of advancing excavation by propelling mechanism 208.

Figure 18:
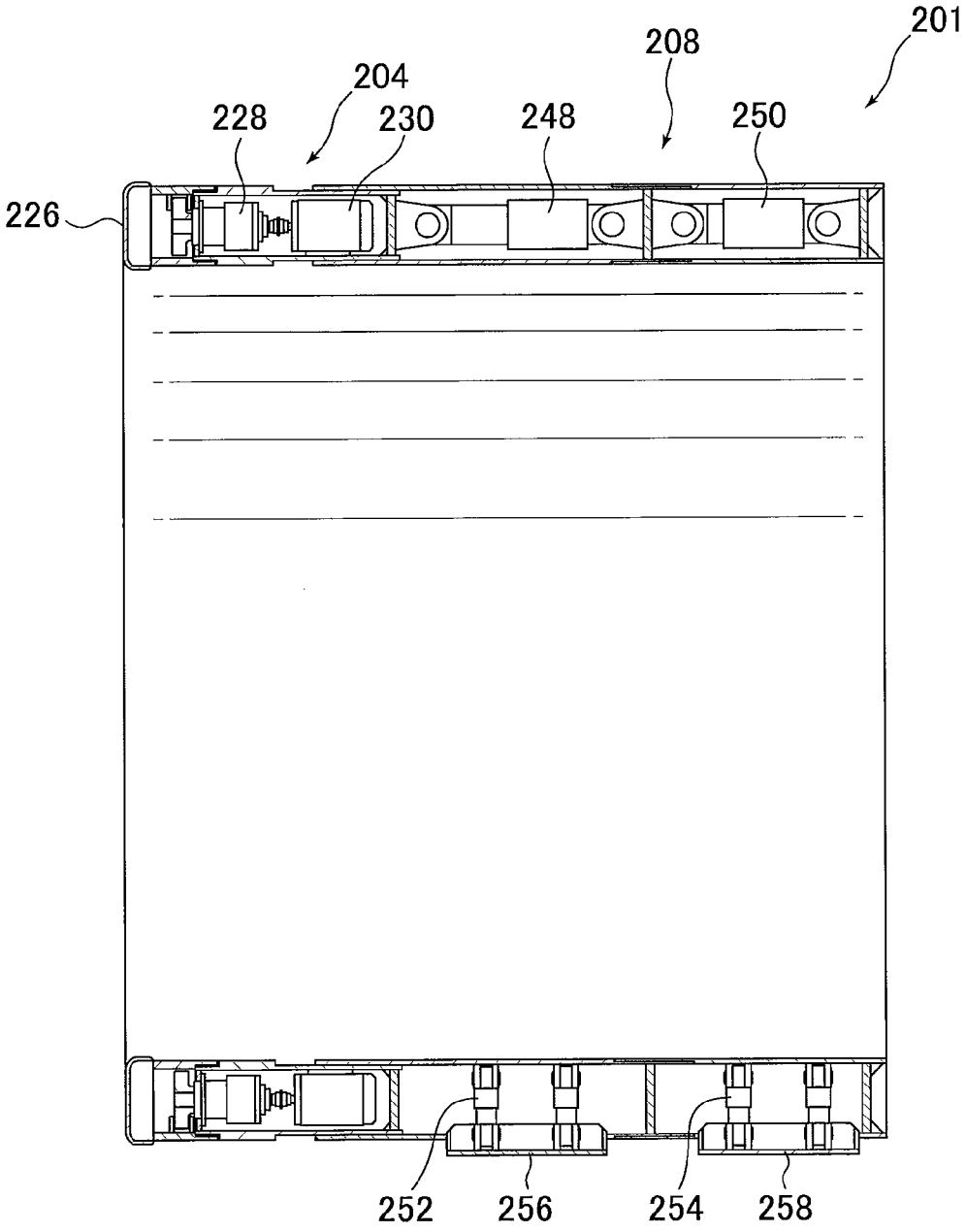
FIG. 18 is a vertical section (No. 1) of an excavating apparatus, for the purpose of explaining a method for propelling an excavating apparatus according to a third embodiment of the present invention.
Figure 19:
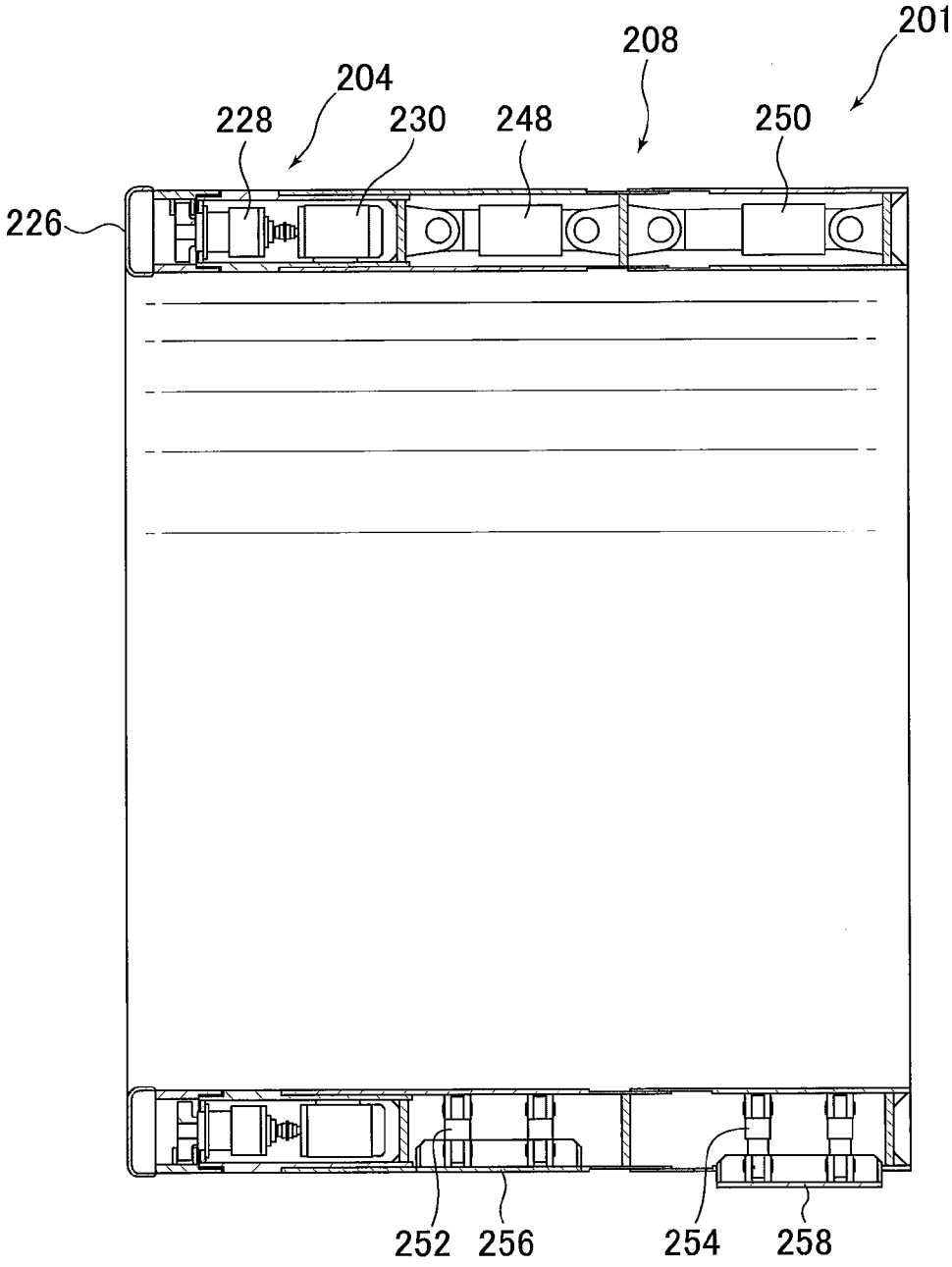
FIG. 19 is a vertical section (No. 2) of an excavating apparatus, for the purpose of explaining a method for propelling an excavating apparatus according to a third embodiment of the present invention.
Figure 20:
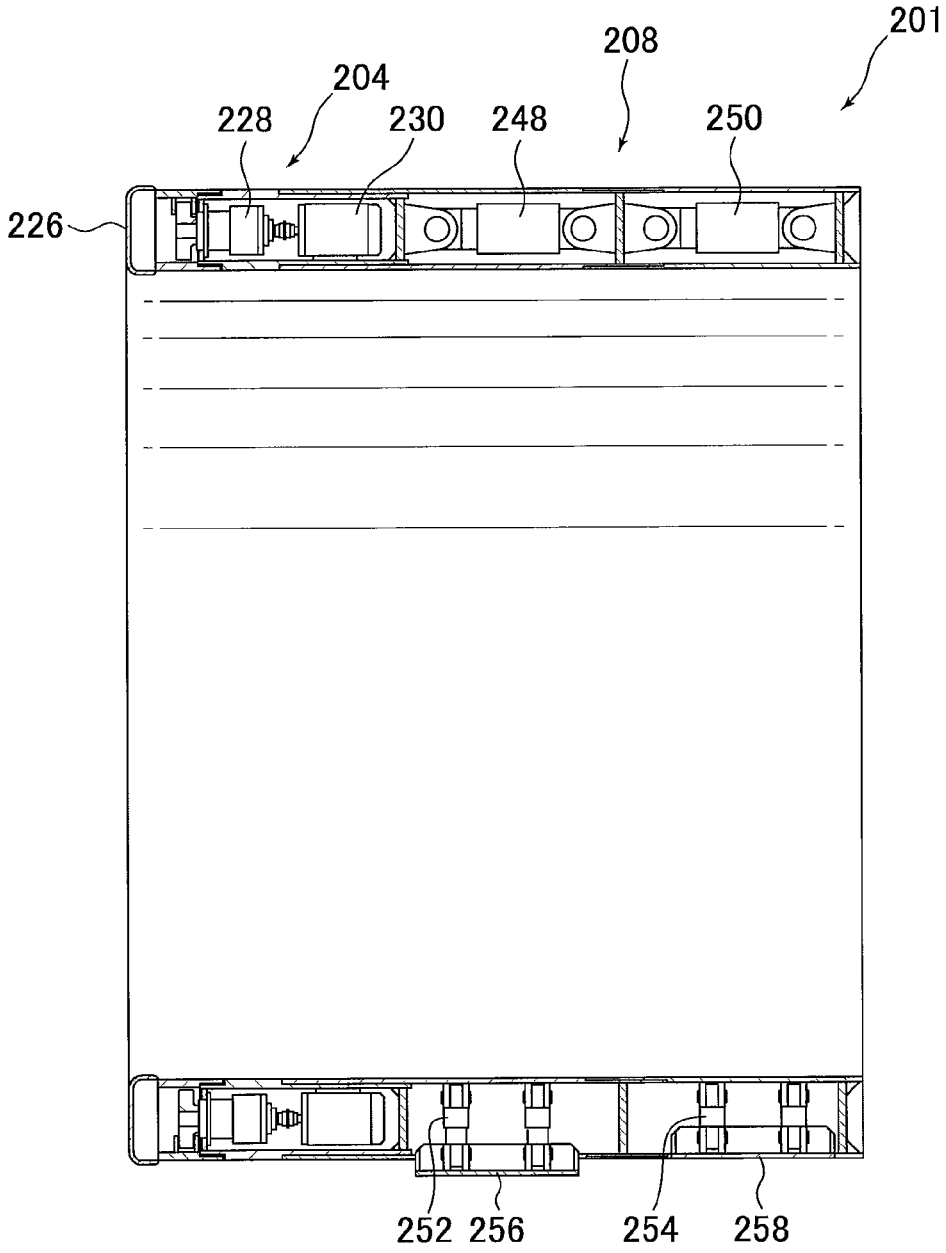
FIG. 20 is a vertical section (No. 3) of an excavating apparatus, for the purpose of explaining the method of propelling an excavating apparatus according to a third embodiment of the present invention.

First, referring to FIGS. 18 through 20, we discuss a method for propelling excavating mechanism 204 using propelling mechanism 208. Note that the propelling operation is accomplished by rotating the excavating mechanism 204 cutter portion 226 about the axis of the excavating apparatus 201 and discharging excavated dirt using excavated dirt discharge mechanism 206.

First, as shown in FIG. 18, the front and rear radial hydraulic jacks 252 and 254 are extended with the front and rear axial hydraulic jacks 248 and 250 in a contracted state so that surrounding ground is pressed by the support plates 256 and 258. With reaction force obtained from the ground using support plates 256 and 258, the front axial hydraulic jack 248 is extended to push the excavating mechanism 204 forward, and ground is excavated in a cylindrical shape by the excavating mechanism 204.

In this manner, as shown in FIG. 19, once excavation has been carried out over a predetermined distance, the front radial hydraulic jack 252 is caused to contract and ground is pressed by the rear support plate 258 alone. The front axial hydraulic jack 248 is then caused to contract and the rear axial hydraulic jack 250 is extended at that same speed. This enables the front shell body 212 to be advanced while maintaining the position of the excavating mechanism 204.

Next, as shown in FIG. 20, the front radial hydraulic jack 252 is extended and ground is pressed by the front support plate 256, while the rear radial hydraulic jack 254 is caused to contract. The rear axial hydraulic jack 250 is then caused to contract. This enables the rear shell body 214 to be advanced while maintaining the position of the excavating mechanism 204 and the front shell body 212.

By repeating the aforementioned steps, the excavating mechanism 204 can be made to advance forward and the excavating apparatus 201 can be propelled.

Together with the aforementioned propelling operation, the cutter portion 226 is rotated to excavate ground. In other words, the motor 230 of the excavating mechanism 204 is rotated in a state whereby the cutter portion 226 pushed against the ground by the propelling mechanism 208. The rotary force of the motor 230 is transferred to speed reducer 228, where torque is amplified, and cutter portion 226 is rotated via pinion 260 and pin rack 234. When the cutter portion 226 rotates, ground is first excavated in a saw-tooth sectional shape by roller bits 236, then surface unevenness is ground off using scraper 240. This enables ground to be excavated in an annular shape. Behind the excavating apparatus 201, a temporary protection plate 272 is attached to the inner circumferential surface of the annularly excavated tunnel. Note that excavated dirt resulting from the excavation of ground is taken in to the intake hole 238 on the cutter portion 226 and discharged through excavated dirt discharge pipe 242 by excavated dirt discharge mechanism 206 to behind the excavating apparatus 201.

In parallel to the forward excavation work above, ground 264 in the inside of the portion excavated in an annular shape by the excavating apparatus 201 is excavated. This excavating work may be done using a breaker 266 or an apparatus such as a backhoe or the like. Excavated dirt resulting from the excavation of ground is loaded onto a dump truck 270 by a Schaeff loader 268 and conveyed outside the tunnel.

Next, in the part of the total tunnel cross section in which excavation is completed, temporary protection plate 272 is removed from the inner circumferential surface of the tunnel, and lining using a segment 274 or the like is installed.

The steps above enable the construction of a circular section tunnel.

In the present embodiment, reaction force is not obtained from a lining such as segments, as is done in the shield construction method; rather reaction force is received by pressing support plates 256 and 258 against ground when excavating ground in an annular shape using excavating apparatus 201, therefore a greater reaction force can be received. Hence even in ground where bedrock strength is approximately 120 to 200 MPa, such as granite, and the application of the shield construction method is difficult, excavation work can be performed using the excavating apparatus 201 of the present embodiment.

Furthermore, because reaction force is taken from the ground, the excavating apparatus 201 can be propelled even if lining work using segments or the like is not completed, and construction can be efficiently carried out.

In addition, when the excavating mechanism 204 is advanced toward the ground by the excavating mechanism 208, reaction force is received by pressing against the ground using the front and rear support plates 256 and 258, therefore a larger reaction force can be received.

It is also possible to excavate the tunnel outer perimeter portion in advance and install lining, and since ground left remaining on the inside becomes a restraint on the tunnel face, stable construction is possible even in soft ground.

Figure 21:
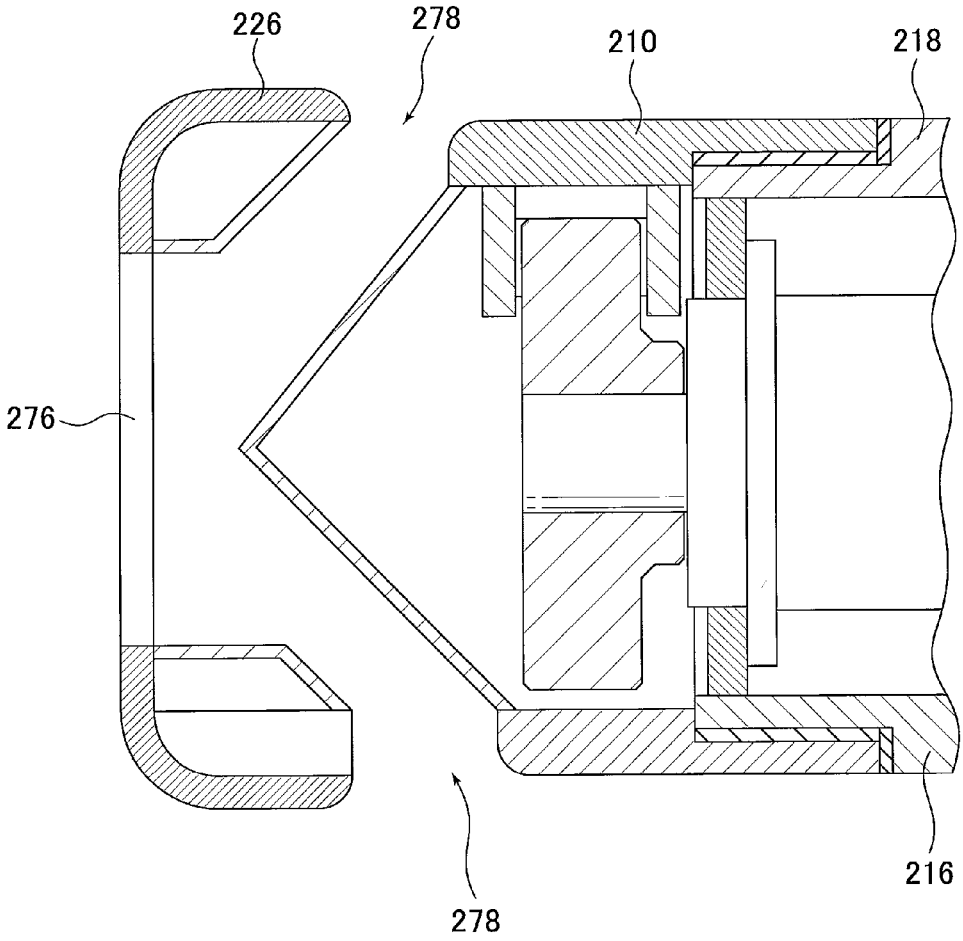
FIG. 21 is an expanded vertical section of the leading end portion of an excavating mechanism, for the purpose of explaining another method for discharging excavated dirt in an excavating apparatus according to a third embodiment of the present invention.

Note that in the above-described embodiment excavated dirt taken in from the intake holes 238 in the cutter portion 226 is transported to the rear of the excavating apparatus 201 through excavated dirt discharge pipe 242, but the invention is not limited thereto, and as shown in FIG. 21, may also be constituted by causing the excavated dirt intake opening 276 of the cutter portion 226 and discharge port 278 disposed on the two sides of excavating portion shell body 210 to communicate, thereby discharging excavated dirt taken in from the excavated dirt intake opening 276 to the rear through the gap between excavating portion shell body 210 and the ground; in other words, there is no restriction on the constitution for discharging excavated dirt.

Furthermore, the embodiment above provided front and rear axial hydraulic jacks 248 and 250, but the invention is not limited thereto, and it is also acceptable to provide a single axial hydraulic jack.

In addition, the propelling mechanism 108 described in the second embodiment can also be used in place of the propelling mechanism 208 of the present embodiment.

What is claimed is:

1. A tunnel excavating apparatus for excavating tunnels in earth, comprising:

tubular shell bodies defining a cylindrical space inside and comprising a tubular excavating portion shell body, a tubular front shell body, and a tubular rear shell body disposed axially in series in this order from a leading end of the tunnel excavating apparatus towards a tail thereof, each shell body being shaped tubularly by coaxially arranged inner and outer cylindrical surfaces;

an excavating mechanism disposed on a front face of the excavating portion shell body and having a rotationally driven annular cutting portion; and a propelling mechanism disposed within the front and rear shell bodies for propelling the excavating mechanism forward in an excavation advancing direction, wherein the propelling mechanism comprises:

a projection mechanism that includes front radial jacks being arranged in the front shell body circumferentially of the front shell body, the front radial jacks being extendable to radially push out parts of the outer cylindrical surface of the front shell body to secure the front shell body against a tunnel being excavated, and rear radial jacks being arranged in the rear shell body circumferentially of the rear shell body, the rear radial jacks being extendable to radially push out parts of the outer cylinder surface of the rear shell body to secure the rear shell body against the tunnel being excavated; and an extension mechanism that includes front axial jacks being interposed between the excavating portion shell body and the front shell body to axially push the excavating portion shell body forward relative to the front shell body and rear axial jacks being interposed between the front shell body and the rear shell body to axially push the front shell body forward relative to the rear shell body, and further wherein the annular cutting portion is formed with an intake opening for introducing excavated dirt inside the excavating portion shell body, and the excavating portion shell body is formed with a discharge gap for discharging the introduced dirt out from the excavating portion shell body into the cylindrical space.

2. A tunnel excavating method for excavating tunnels in earth using a tunnel excavating apparatus, the tunnel excavating apparatus comprising:

tubular shell bodies defining a cylindrical space inside and comprising a tubular excavating portion shell body, a tubular front shell body, and a tubular rear shell body disposed axially in series in this order from a leading end of the tunnel excavating apparatus towards a tail thereof, each shell body being shaped tubularly by coaxially arranged inner and outer cylindrical surfaces;

an excavating mechanism disposed on a front face of the excavating portion shell body and having a rotationally driven annular cutting portion; and a propelling mechanism disposed within the front and rear shell bodies for propelling the excavating mechanism forward in an excavation advancing direction, wherein the propelling mechanism comprises:

a projection mechanism that includes front radial jacks being arranged in the front shell body circumferentially of the front shell body, the front radial jacks being extendable to radially push out parts of the outer cylindrical surface of the front shell body to secure the front shell body against a tunnel being excavated, and rear radial jacks being arranged in the rear shell body circumferentially of the rear shell body, the rear radial jacks being extendable to radially push out parts of the outer cylinder surface of the rear shell body to secure the rear shell body against the tunnel being excavated; and an extension mechanism that includes front axial jacks being interposed between the excavating portion shell body and the front shell body to axially push the excavating portion shell body forward relative to the front shell body and rear axial jacks being interposed between the front shell body and the rear shell body to axially push the front shell body forward relative to the rear shell body, and further wherein the annular cutting portion is formed with an intake opening for introducing excavated dirt inside the excavating portion shell body, and the excavating portion shell body is formed with a discharge gap for discharging the introduced dirt out from the excavating portion shell body into the cylindrical space, said method comprising:

a step for excavating ground in an annular shape by extending the front axial jacks and pushing the excavating mechanism forward while the front and rear radial jacks are extended and the front and rear shell bodies are secured against the tunnel being excavated;

a step for contracting the front axial jacks and extending the rear axial jacks to push the front shell body forward while the front radial jacks are contracted to thereby free the front shell body, and the rear radial jacks are extended to thereby secure the rear shell body against the tunnel being excavated;

a step for contracting the rear axial jacks to pull the rear shell body forward while the rear radial jacks are contracted to thereby free the rear shell body, and the front radial jacks are extended to thereby secure the front shell body against the tunnel being excavated;

a following excavation step for excavating ground inside the shell bodies; and a step for introducing excavated dirt from the intake opening into the excavating portion shell body and discharging the introduced dirt out from the excavating portion shell body into the cylindrical space through the discharge gap.

* * * * *